US006771141B2

(12) United States Patent
Iida et al.

(10) Patent No.: US 6,771,141 B2
(45) Date of Patent: Aug. 3, 2004

(54) DIRECTIONAL COUPLER

(75) Inventors: Naoki Iida, Sagamihara (JP); Masahiko Kawaguchi, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/270,690

(22) Filed: Oct. 16, 2002

(65) Prior Publication Data

US 2003/0076191 A1 Apr. 24, 2003

(30) Foreign Application Priority Data

Oct. 19, 2001 (JP) ..... 2001-322158
Feb. 27, 2002 (JP) ..... 2002-051734

(51) Int. Cl.[7] ..... H01P 5/12
(52) U.S. Cl. ..... 333/116; 333/109
(58) Field of Search ..... 333/109, 110, 333/116, 246

(56) References Cited

U.S. PATENT DOCUMENTS 5,448,771 A * 9/1995 Klomsdorf et al. ..... 455/126
6,342,681 B1 * 1/2002 Goldberger et al. ..... 174/261

* cited by examiner

*Primary Examiner*—Robert Pascal
*Assistant Examiner*—Dean Takaoka
(74) *Attorney, Agent, or Firm*—Keating & Bennett, LLP

(57) ABSTRACT

A directional coupling device includes a main line and a sub line, and line coupling (distributed constant coupling) is effected between the main line and the sub line, each of which has a portion that is arranged substantially parallel to each other and alongside each other. The sub line is longer than the main line. The main line is a substantially straight line or a substantially straight line bending at a predetermined position, i.e., a non-spiraling line, and the sub line is arranged to circle in a spiral manner by bending a substantially straight line at predetermined positions. Thus, a small high-capability directional coupler has excellent isolation properties and directivity, and little insertion loss or deterioration in reflection properties.

15 Claims, 22 Drawing Sheets

DIRECTIONAL COUPLER

BACKGROUND OF THE INVENTION

1. Field of the Invention

The present invention relates to a directional coupler which, for example, extracts portions of output signals, and outputs the extracted portions of signals as feedback control signals, and particularly relates to a directional coupler used for an output monitor of mobile communication equipment such as a cellular telephone, and other such devices.

2. Description of the Related Art

Conventionally, directional couplers take advantage of a phenomena wherein, in the event that two conductor patterns with ¼ wavelength of the usage frequency are arranged so as to be mutually parallel with one of the conductor patterns as a main line, applying signals to the main line results in signals that are proportionate to the voltage propagating the main line being output at one end of the other line. Such directional couplers are in widespread use as output adjusting monitors for cellular telephones, and other suitable devices.

FIG. 27 is a model plan view illustrating an example of a directional coupler. This directional coupler 100 includes an insulating member 200, and a main line 300 and sub line 400 formed on the insulating member 200. The main line 300 and sub line 400 are partially parallel with a gap therebetween, and it is at this parallel portion that coupling occurs. The sub line 400 can extract a portion of the signals flowing along the main line 300 by the coupling.

For example, in the event that such a directional coupling is assembled into a cellular telephone, the directional coupler 100 is used at the high-frequency amplifier circuit of the transmitting side. One end 300α of the main line 300 is connected to the high-frequency amplifier circuit, while the other end 300β is connected to an antenna. Also, one end 400α of the sub line 400 is connected to a circuit that controls the high-frequency amplifier circuit, and the other end 400β is terminated at a terminating resistor. The sub line 400 extracts (detects) a portion of the voltage passing through the main line 300, and the detected signals are sent to the circuit for controlling the high-frequency amplifier circuit, where high-frequency voltage output from the high-frequency amplifier circuit is controlled by this circuit, thereby maintaining the intensity of signals emitted from the antenna within a predetermined range.

Incidentally, loss which occurs upon being input from the one end 300α of the main line 300 and output at the other end 300β is referred to as "insertion loss", and voltage input from the one end 300α of the main line 300 and output at the other end 400α of the sub line 400 is referred to as "degree of coupling". Also, the minute voltage observed at the other end 400α of the sub line 400, as opposed to the voltage output at the input end 300α which is voltage input from the one end 300α of the main line 300 but reflected within the coupler or at the output end (other end) 300β and output at the input end 300α, is referred to as "isolation". Further, the ratio of the "degree of coupling" and "isolation" is referred to as "directivity".

Now, directional couplers 100 are being reduced in size, due to the devices in which they are being assembled, such as cellular telephones, being reduced in size. This reduction in size requires reduction in the length of the parallel portion between the main line 300 and the sub line 400. This causes a problem in that a sufficient degree of coupling cannot be obtained.

Accordingly, an arrangement can be conceived to reduce the gap between the main line 300 and sub line 400, in order to obtain sufficient coupling. However, excessively narrowing the gap may result in insulation destruction between the main line 300 and sub line 400, so there is a limit to how narrow the gap between the main line 300 and sub line 400 can be, and satisfactory coupling cannot be obtained by this arrangement. Accordingly, a directional coupler 100 such as shown in FIG. 28 has been proposed. With this directional coupler 100, sub lines 400A and 400B are arranged in parallel on both sides of the main line 300 with gaps therebetween, and both ends of the sub lines 400A and 400B are each short-circuited. This configuration attempts to obtain satisfactory degree of coupling by increasing the sub line portion that is parallel to the main line 300.

Also, as another proposal, an arrangement can be conceived wherein the width of the lines 300 and 400 are narrower, thereby disposing long lines on the insulating member 200. However, in this case, an increase of loss of line increases the insertion loss, resulting in increased electric power consumption of the equipment in which the directional coupler 100 is assembled. This leads to the problem of reduced driving time with cellular telephone terminals and other devices which are generally driven by batteries.

Also, an arrangement can be conceived wherein the lines are longer in order to raise the degree of coupling, but making the lines longer causes the problem of increased insertion loss occurring.

On the other hand, as a result of a reduced permissive area for forming the conductor patterns due to reduction in size, there are problems in that securing sufficient line length is difficult, and in that consistency with circuits to which connection is made becomes poor, leading to deterioration in reflection properties. That is, the size of directional couplers is being reduced by forming the lines to have meandering, spiral, or helical configurations, thereby reducing the area and volume necessary for forming the conductor patterns.

Particularly, in the event of forming the lines (conductors) to have spiral or helical shapes, the inductance component can be efficiently obtained, and thus is advantageous in that the length of the lines to be formed can be reduced.

However, in the event that the lines (conductors) are formed to have spiral or helical shapes, there is the problem that deterioration in isolation properties occurs. Isolation properties can be improved by adjusting the gap between the main line and the sub line, and so forth, but in this case, the coupling between the main line and the sub line is low, so in practice, it is difficult to improve the directivity, which is the ratio between the degree of coupling and the isolation.

SUMMARY OF THE INVENTION

In order to solve the above-described problems, preferred embodiments of the present invention provides a small and high-capability directional coupler which has excellent isolation properties and directivity while maintaining a desired degree of coupling, with minimal deterioration in insertion loss and reflection properties.

According to a preferred embodiment of the present invention, in a directional coupling device, line coupling (distributed constant coupling) is effected between a main line and a sub line by positioning at least a partial region of a main line and sub line substantially parallel with one another when viewed in a planar manner, and the line length of the sub line is longer than the line length of the main line.

With a side edge type directional coupler wherein line coupling (distributed constant coupling) is effected between the main line and the sub line by positioning at least a partial region of a main line and a sub line substantially parallel with one another, forming the line length of the sub line to be longer than the line length of the main line improves isolation properties, and the desired degree of coupling can be obtained while securing directivity.

Also, there is no lengthening of the main line, so the insertion loss is not increased and deterioration in reflection properties is prevented, and the electric power consumption in battery-driven mobile communication equipment is minimized.

Note that the phrase "line coupling (distributed constant coupling) is effected between the main line and sub line" in preferred embodiments of the present invention is a concept indicating that the main line and sub line are coupled by distributed constant coupling from the capacity component C and inductance component L, and does not encompass coil coupling such as two coils being electromagnetically coupled.

Also, the directional coupling device may have the main line formed as a substantially straight line or a substantially straight line which bends at a predetermined position but not a line which circles in spiral fashion, the sub line being a line which circles in spiral fashion by bending a substantially straight line at a plurality of predetermined positions.

Forming the sub line so as to have a spiral shape to extend the length thereof enables a high degree of coupling to be obtained, while keeping isolation low.

Also, the length of the main line can be made shorter than the sub line, so an increase in insertion loss of the main line can be prevented in a reliable manner, and decay of signals can be prevented in battery-driven terminals, so signals can be efficiently transmitted. Consequently, this enables long driving times for battery-driven terminals.

Also, forming the main line as a substantially straight line or a substantially straight line bending at a predetermined position, i.e., a non-spiral line, and forming the sub line to have a spiral configuration by bending a substantially straight line at a plurality of predetermined positions, enables a highly-reliable directional coupler with desired properties to be provided, without requiring complicated line patterns.

Also, the main line and sub line may be embedded in an insulating member of a layered structure including a plurality of insulating layers that have been stacked on each other.

Embedding the main line and sub line in an insulating member having a layered structure including a plurality of insulating layers that have been stacked raises the line density, thereby enabling further reduction in size of the directional coupler.

Also, line coupling of the sub line to the main line may be effected by a portion of the sub line being disposed on both sides of the main line at a predetermined region of the main line.

With a configuration wherein the sub line is disposed on both sides of the main line at a predetermined region of the main line, an even higher degree of coupling can be obtained due to the coupling between the main line and the sub lines on either side thereof.

Also, line coupling of the sub line to the main line may be effected by a portion of the sub line being disposed above and below the main line with the insulating layer being disposed therebetween.

With an arrangement wherein the main line and sub line layered with the insulating layer disposed therebetween are made to face one another (i.e., to be superimposed with the insulating layer introduced therebetween), thereby effecting line coupling (distributed constant coupling) between the main line and sub line, directional couplers with various degrees of coupling can be readily obtained by simply adjusting the thickness of the insulating layer, even without changing the line pattern, and small high-capability directional couplers can be obtained. Also, with this arrangement as well, forming the line length of the sub line to be greater than the line length of the main line improves isolation properties, and the desired degree of coupling can be obtained while securing directivity, and moreover, there is no lengthening of the main line, so occurrence of increases in insertion loss and deterioration in reflection properties can be prevented, and the electric power consumption in battery-driven mobile communication equipment is minimized.

Also, line coupling of the sub line to the main line may be effected by a portion of the sub line being disposed at two of the following locations: at least one side of the two sides of the main line; above the main line; and below the main line.

As a result of such a novel arrangement and configuration, the length of the electromagnetically coupled portion between the sub line and the main line can be significantly extended, without increasing the size of the substrate. Accordingly, the degree of coupling between the main line and sub line is increased, and directivity is improved even more.

Also, the main line and the sub line may be formed by photolithography using at least one of photosensitive electroconductive material and photosensitive resist, or other suitable material.

Forming the main line and the sub line by photolithography using at least one of photosensitive electroconductive material and photosensitive resist, or other suitable material, enables fine and highly-precise line patterns to be formed, thereby yielding a directional coupler having the desired properties.

Also, the line width of the main line may be greater than the line width of the sub line.

In the event that the line width of the main line is greater than the line width of the sub line, loss at the time of signals passing through the main line is minimized, so efficient signal transmission with suppressed electric power consumption can be realized.

Other features, elements, advantages and characteristics of the present invention will become more apparent from the following detailed description of preferred embodiments thereof with reference to the attached drawings.

BRIEF DESCRIPTION OF THE DRAWINGS

FIGS. 4A and 4B are diagrams illustrating a procedure in a manufacturing method for the directional coupler relating to the first preferred embodiment of the present invention, wherein FIG. 4A is a plan view and FIG. 4B is a side cross-sectional view;

FIGS. 5A and 5B are diagrams illustrating another procedure in a manufacturing method for the directional coupler relating to the first preferred embodiment of the present invention, wherein FIG. 5A is a plan view and FIG. 5B is a side cross-sectional view;

FIGS. 6A and 6B are diagrams illustrating a further procedure in a manufacturing method for the directional coupler relating to the first preferred embodiment of the present invention, wherein FIG. 6A is a plan view and FIG. 6B is a side cross-sectional view;

FIGS. 7A and 7B are diagrams illustrating yet another procedure in a manufacturing method for the directional coupler relating to the first preferred embodiment of the present invention, wherein FIG. 7A is a plan view and FIG. 7B is a side cross-sectional view;

FIGS. 8A and 8B are diagrams illustrating yet another procedure in a manufacturing method for the directional coupler relating to the first preferred embodiment of the present invention, wherein FIG. 8A is a plan view and FIG. 8B is a side cross-sectional view;

FIGS. 11A and 11B are diagrams illustrating a procedure in a manufacturing method for the directional coupler relating to the second preferred embodiment of the present invention, wherein FIG. 11A is a plan view and FIG. 11B is a side cross-sectional view;

FIGS. 12A and 12B are diagrams illustrating another procedure in a manufacturing method for the directional coupler relating to the second preferred embodiment of the present invention, wherein FIG. 12A is a plan view and FIG. 12B is a side cross-sectional view;

FIGS. 13A and 13B are diagrams illustrating a further procedure in a manufacturing method for the directional coupler relating to the second preferred embodiment of the present invention, wherein FIG. 13A is a plan view and FIG. 13B is a side cross-sectional view;

FIGS. 14A and 14B are diagrams illustrating yet another procedure in a manufacturing method for the directional coupler relating to the second preferred embodiment of the present invention, wherein FIG. 14A is a plan view and FIG. 14B is a side cross-sectional view;

FIGS. 15A and 15B are diagrams illustrating yet another procedure in a manufacturing method for the directional coupler relating to the second preferred embodiment of the present invention, wherein FIG. 15A is a plan view and FIG. 15B is a side cross-sectional view;

FIGS. 16A and 16B are diagrams illustrating yet another procedure in a manufacturing method for the directional coupler relating to the second preferred embodiment of the present invention, wherein FIG. 16A is a plan view and FIG. 16B is a side cross-sectional view;

FIGS. 17A and 17B are diagrams illustrating yet another procedure in a manufacturing method for the directional coupler relating to the second preferred embodiment of the present invention, wherein FIG. 17A is a plan view and FIG. 17B is a side cross-sectional view;

DETAILED DESCRIPTION OF PREFERRED EMBODIMENTS

In the following, the present invention will be described in further detail, by way of preferred embodiments.

Figure 1A:
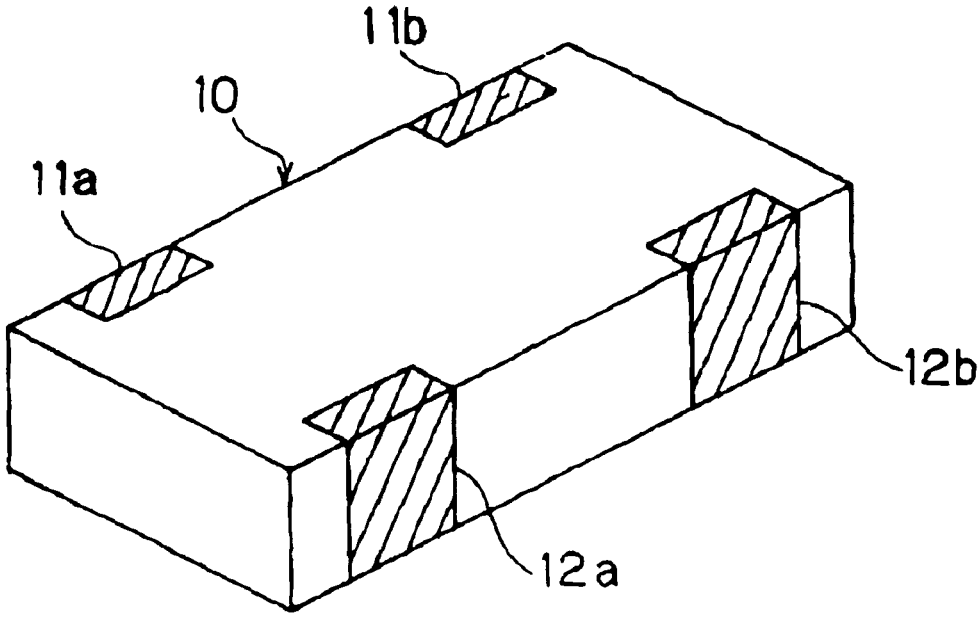
FIG. 1A is a perspective view illustrating the external configuration of a directional coupler according to a first preferred embodiment of the present invention.
Figure 1B:
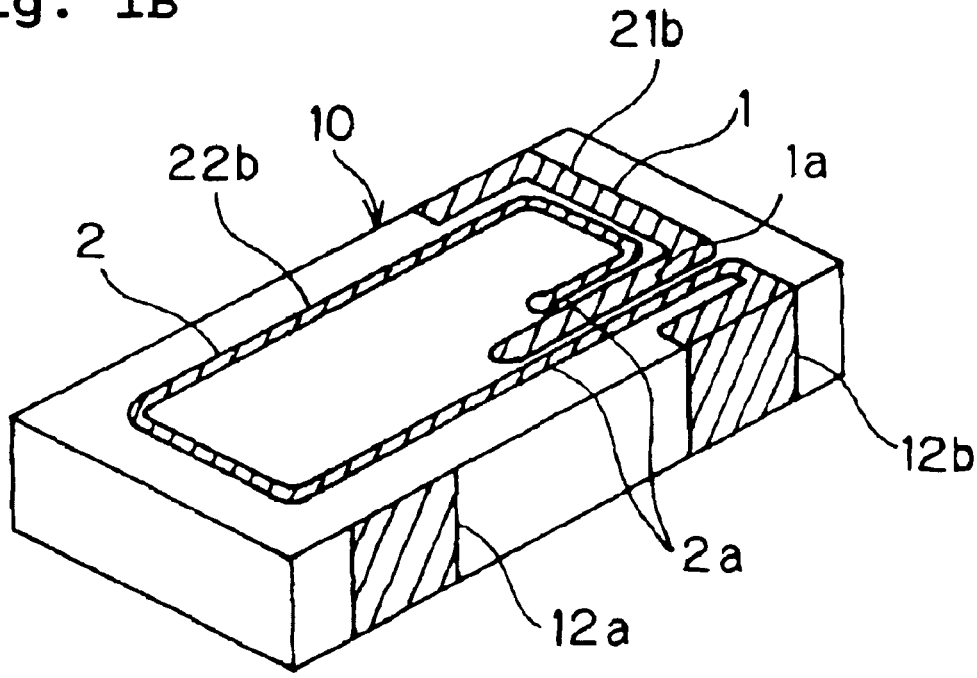
FIG. 1B is a perspective view illustrating the layout of an internal conductor pattern on a lower layer.
Figure 2A:
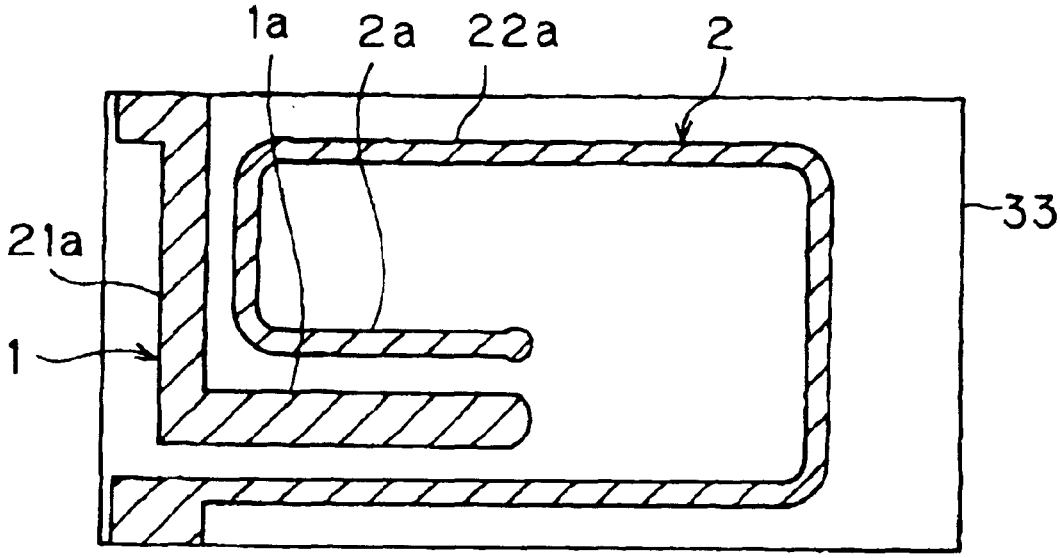
FIG. 2A is a plan view illustrating an internal conductor pattern on an upper layer, configuring a main line and sub line of the directional coupler according to the first preferred embodiment of the present invention.
Figure 2B:
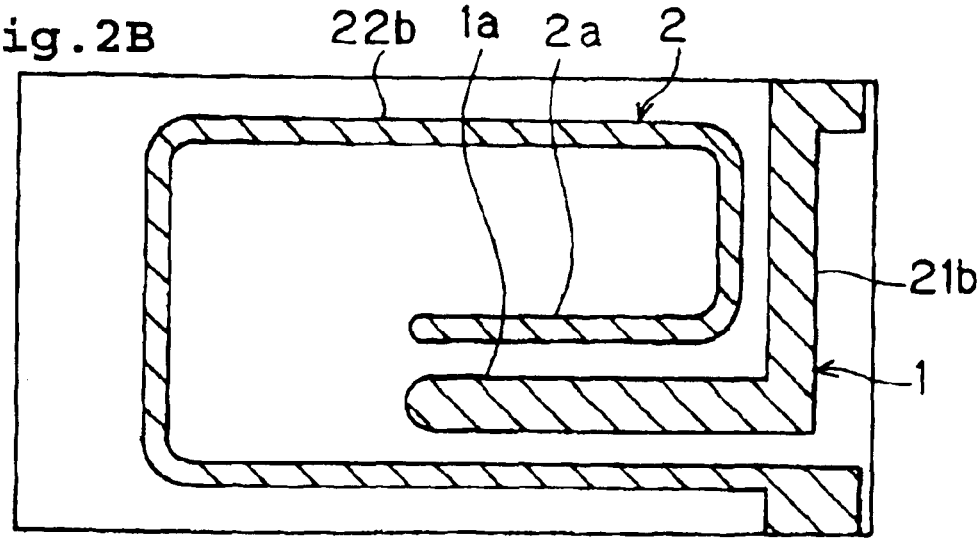
FIG. 2B is a plan view illustrating the internal conductor pattern on the lower layer.
Figure 3:
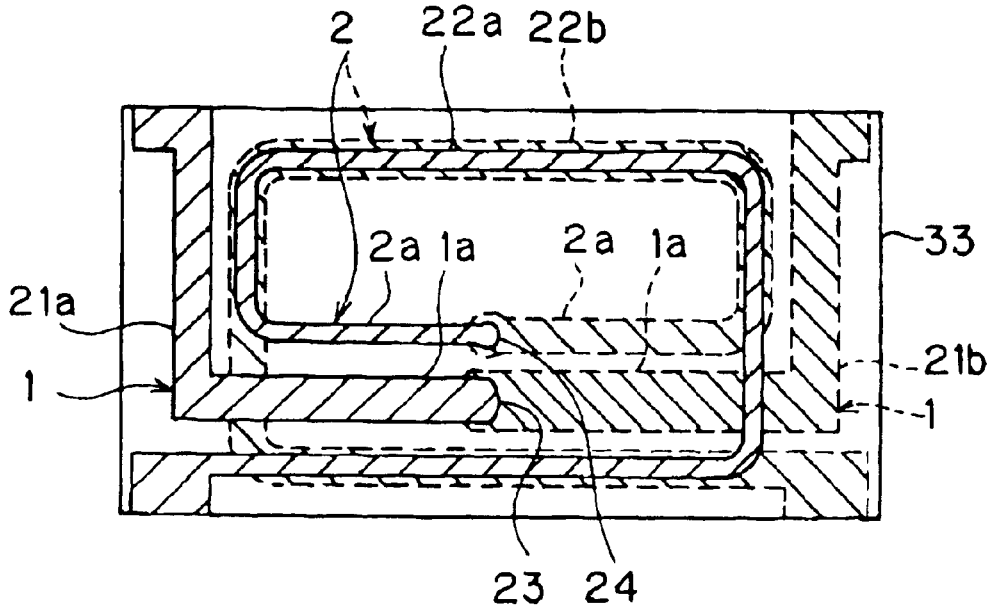
FIG. 3 is a plane view illustrating the state of the internal conductor patterns on the upper layer and the lower layer shown in FIGS. 2A and 2B layered.

FIG. 1A is a perspective view illustrating the external configuration of a directional coupler according to a preferred embodiment of the present invention (first preferred embodiment), FIG. 1B is a perspective view illustrating the layout of an internal conductor pattern on a lower layer, FIGS. 2A and 2B are plan views illustrating internal conductor patterns on an upper layer and lower layer defining the main line and sub line, and FIG. 3 is a plane view illustrating the state of the upper layer and lower layer internal conductor patterns shown in FIGS. 2A and 2B, layered.

As shown in FIGS. 1A through 3, the directional coupler according to the first preferred embodiment has a structure wherein a main line 1 and sub line 2 having a two-layered structure are arranged in a device 10 including an insulating member made of alumina or other suitable material, and wherein external electrodes 11*a* and 11*b* conducting with both ends of the main line 1, and external electrodes 12*a* and 12*b* conducting with both ends of the sub line, are disposed on both sides of the device 10.

That is to say, with the directional coupler according to the first preferred embodiment, the partial regions 1*a* and 2*a* of the main line 1 and sub line 2 are substantially parallel with one another, so the side portions of each extending substantially parallel facing one another, i.e., a side edge type directional coupler, wherein line coupling (distributed constant coupling) is effected between the main line and sub line, thereby defining coupling lines.

Also, with the directional coupler according to the first preferred embodiment, the main line 1 and the sub line 2 have a two-layered structure, wherein the main line 1 is formed by connecting an upper main line internal conductor 21*a* and a lower main line internal conductor 21*b* which are disposed with an insulating layer 33 (see FIGS. 2, 3, 6, 7, etc.) introduced therebetween by a via hole 23, and the sub line 2 is defined by connecting an upper sub line internal conductor 22*a* and a lower sub line internal conductor 22*b* by a via hole 24.

Next, a method for manufacturing the directional coupler according to the first preferred embodiment will be described. Note that while in the following, description will be made regarding a case of manufacturing one directional coupler, generally, a method is preferably used wherein a great number of main lines and sub lines are formed on a mother substrate, which is then cut at predetermined positions to divide the mother substrate into individual directional couplers, thereby simultaneously manufacturing a great number of directional couplers.

Figure 4A:
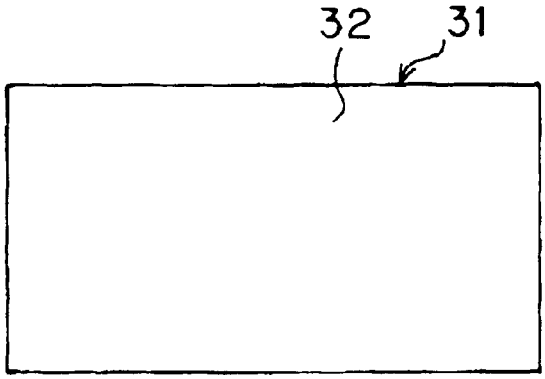
Figure 4B:
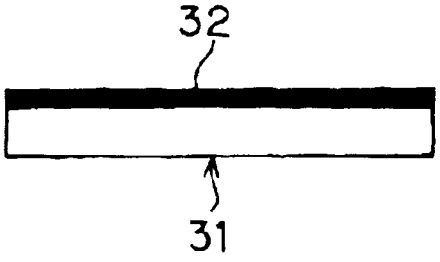

(1) First, as shown in FIGS. 4A and 4B, a conductive film 32 for forming internal conductors is formed on a substrate 31. Various types of ceramic substrates (e.g., alumina substrates, glass ceramic substrates, glass substrates, ferrite substrates, dielectric substrates or other suitable substrates) may be used for the substrate 31. Also, various types of film-forming processes may be used as the method for forming the conductive film 32 for forming internal conductors, such as printing or film formation (sputtering, vapor deposition, or other suitable method).

Figure 5A:
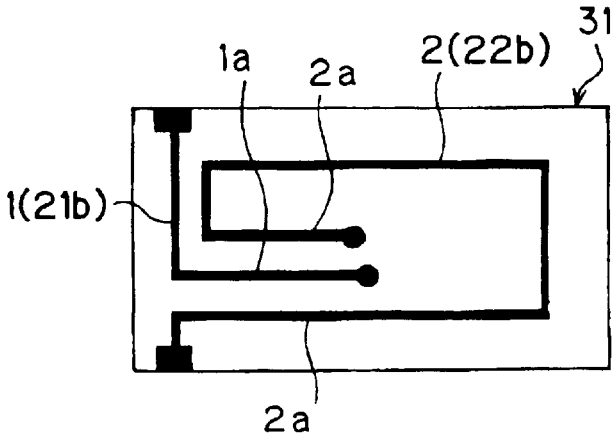
Figure 5B:
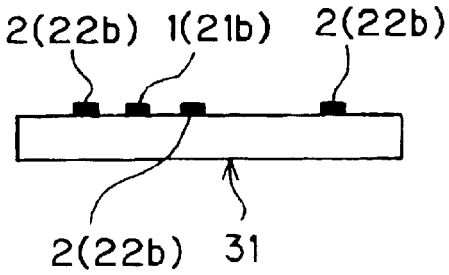

(2) Next, the conductive film 32 is patterned by photolithography, so as to form predetermined internal conductive patterns 21*b* and 22*b*, such as shown in FIGS. 5A and 5B.

At the time of forming the internal conductive patterns 21*b* and 22*b* by photolithography, the predetermined internal conductive patterns 21*b* and 22*b* can be formed by, for example, coating the conductive film 32 with a photo resist, which is exposed through a photo mask having a predetermined pattern, performing developing to remove the unnecessary photo-resist with a developing fluid (solvent), and then removing portions of the conductive film 32 not covered by the photo-resist (i.e., the unnecessary portions) by etching or other suitable process.

Wet etching, dry etching, lift-off, additive, semi-additive, and other such methods may be used for forming the internal conductive patterns.

Also, in some cases, the internal conductive patterns may be formed by printing a conductive paste on the substrate through a predetermined mask pattern.

Note that while the internal conductive patterns may be formed using known techniques as described above, using photolithography is desirable to efficiently form fine and highly-precise line patterns.

Figure 6A:
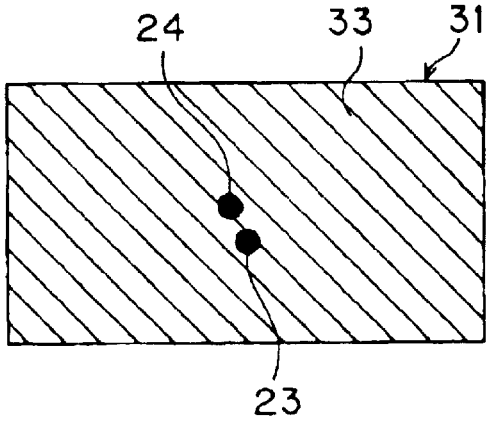
Figure 6B:
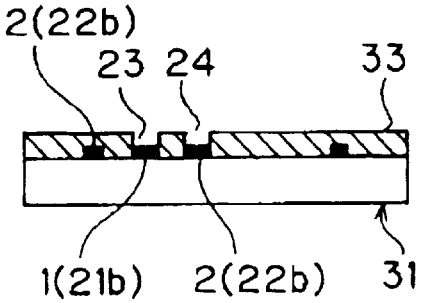

(3) Next, as shown in FIGS. 6A and 6B, an insulating layer 33 is formed so as to cover the entire surface of the substrate 31 upon which are formed the internal conductive patterns 21*b* and 22*b*.

In this first preferred embodiment, photosensitive glass wherein a photosensitive material has been blended into glass or polyimide, or photosensitive polyimide, or other suitable material, may be used for the insulating layer 33.

Then, as shown in FIGS. 6A and 6B, via holes 23 and 24 (for connecting the internal conductive patterns 21*b* and 22*b* formed on the substrate 31 and the internal conductive patterns 21*a* and 21*b* to be formed on the insulating layer 33 in a later step) are formed in the insulating layer 33.

Note that in the event of not using photolithography, glass, polyimide, or other substances, not containing photosensitive material may be used as the material for forming the insulating layer 33.

Figure 7A:
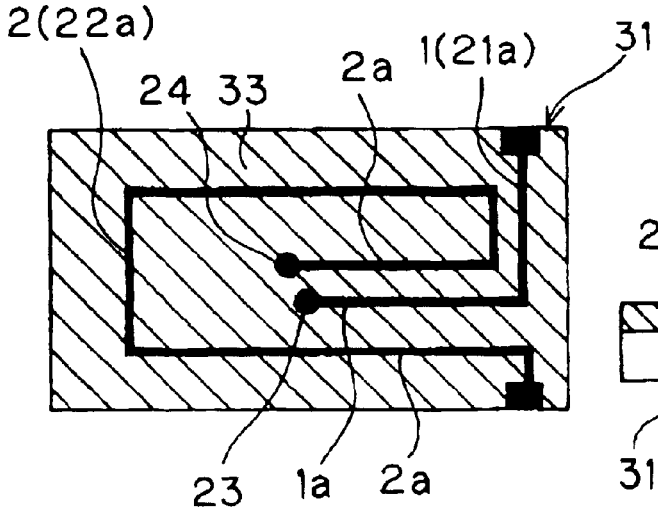
Figure 7B:
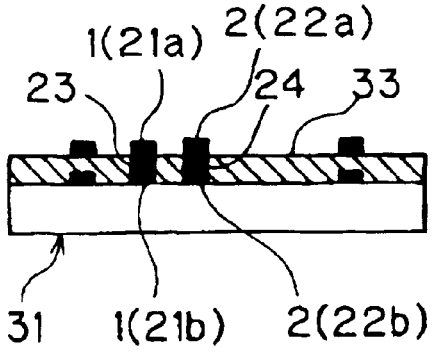

(4) Subsequently, the internal conductive patterns 21*a* and 22*a* are formed on the insulating layer 33 by the same photolithography method as used for forming the internal conductive patterns 21*b* and 22*b*, as shown in FIGS. 7A and 7B.

Figure 8A:
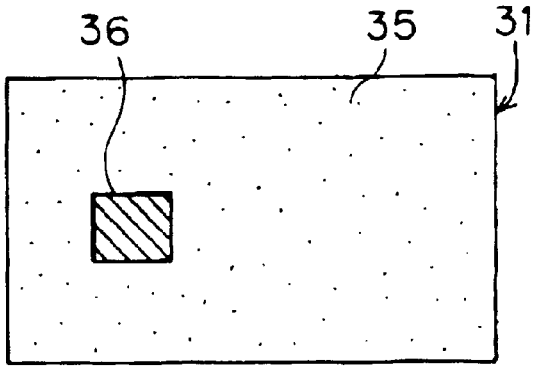
Figure 8B:
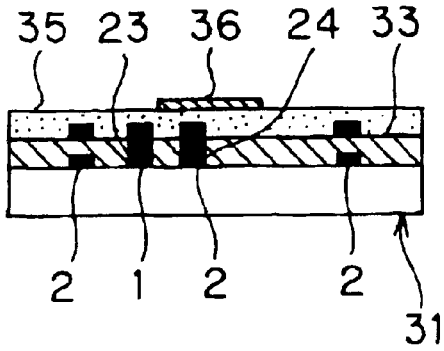

(5) Next, following the step of covering the entire article upon which the internal conductive patterns 21*a* and 22*a* have been formed with an enveloping insulating material 35, a positioning mark 36 is formed on the enveloping insulating material 35 by printing marking material at a predetermined position, as shown in FIGS. 8A and 8B. In the event of using a method wherein a great number of devices are manufactured simultaneously, the mother substrate is cut into the individual devices 10 following the formation of the positioning mark 36.

(6) Then, external electrodes 11*a* and 11*b*, and external electrodes 12*a* and 12*b*, are formed by coating and baking a conductive paste at predetermined positions on the device 10, or a similar method. Thus, a directional coupler such as that shown in FIG. 1 can be obtained.

With the directional coupler according to the first preferred embodiment that is configured as described above, line coupling (distributed constant coupling) is effected between the main line 1 and sub line 2 by positioning at least partial regions 1*a* and 2*a* of the main line 1 and sub line 2 so that the sides thereof are substantially parallel one with another, and also the line length of the sub line 2 is longer than the line length of the main line 1, thereby enabling isolation properties to be improved, while a desired degree of coupling can be obtained while securing directivity.

Also, the main line is short, so increases in insertion loss and deterioration in reflection properties are prevented, and the electric power consumption in battery-driven mobile communication equipment is minimized.

Note that while the main line and the sub line are each two-layer structures in the first preferred embodiment, the main line and the sub line may be single-layer structures, or may be structures having three or more layers.

Figure 9A:
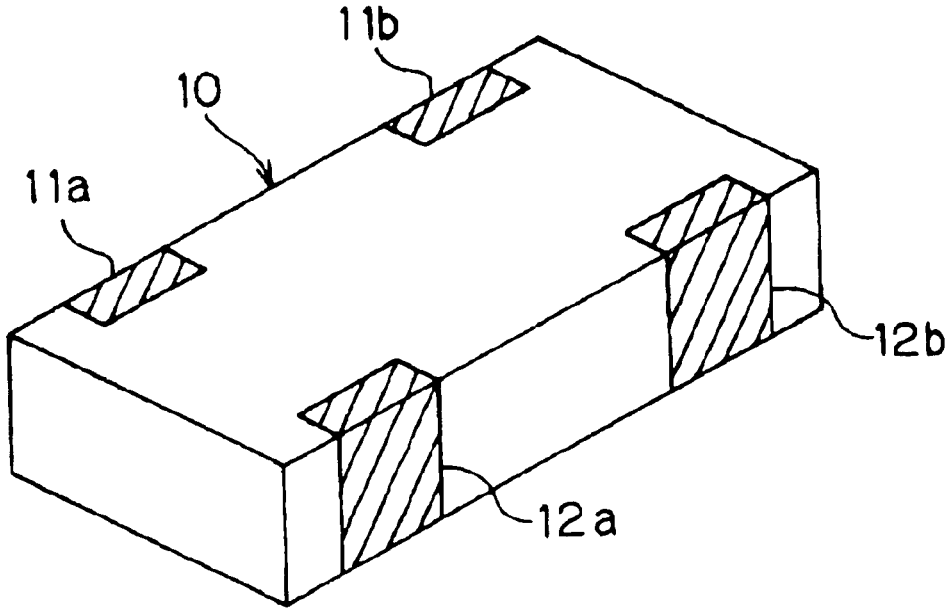
FIG. 9A is a perspective view illustrating the external configuration of a directional coupler according to a second preferred embodiment of the present invention.
Figure 9B:
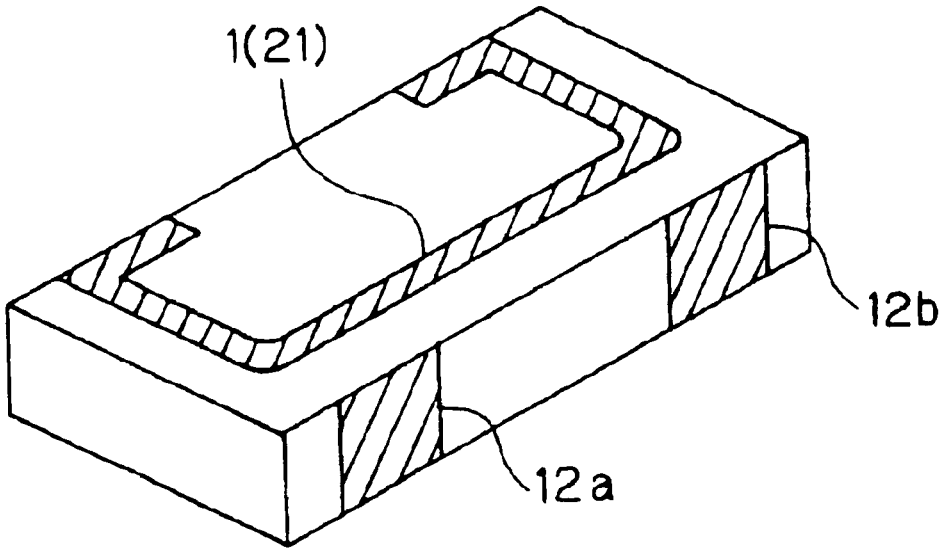
FIG. 9B is a perspective view illustrating the layout of an internal conductor pattern configuring a main line.
Figure 10:
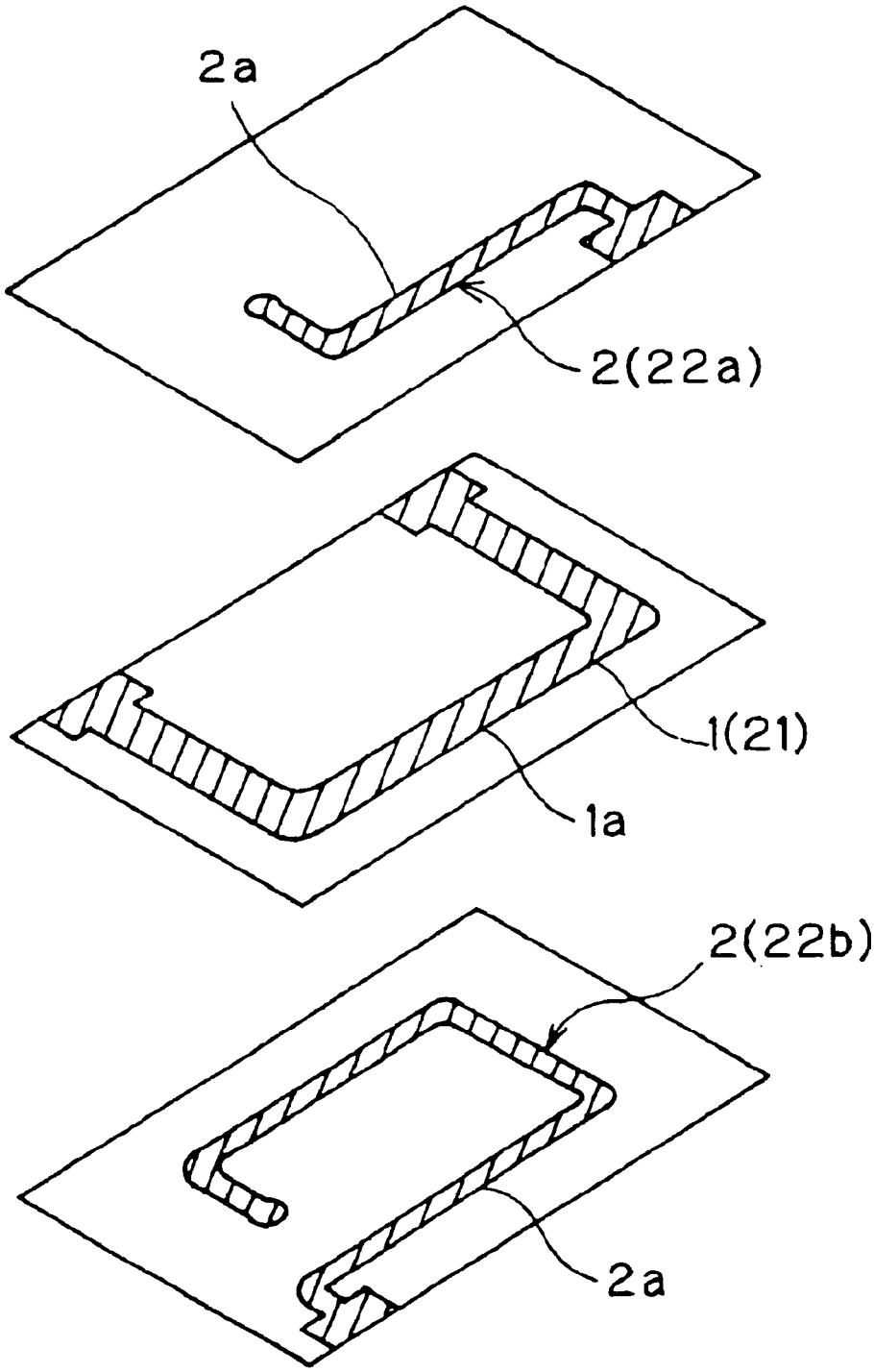
FIG. 10 is a disassembled perspective view illustrating internal conductor patterns configuring the main line and the sub line of the directional coupler according to the second preferred embodiment of the present invention.

FIG. 9A is a perspective view illustrating the external configuration of a directional coupler according to a second preferred embodiment of the present invention, FIG. 9B is a perspective view illustrating the layout of a conductor (an internal conductor pattern making up the main line), and FIG. 10 is a disassembled perspective view illustrating internal conductor patterns configuring the main line and sub line.

As shown in FIGS. 9A through 10, the directional coupler according to the second preferred embodiment has a structure wherein a main line 1 having a one-layer structure and a sub line 2 having a two-layer structure are arranged in a device 10 including an insulating member made of alumina or other suitable material, and wherein external electrodes 11*a* and 11*b* conducting with both ends of the main line 1, and external electrodes 12*a* and 12*b* conducting with the sub line 2, are disposed on both sides of the device 10.

Also, with the directional coupler according to the second preferred embodiment, the sub line 2 has a two-layer structure, wherein the sub line 2 is formed by connecting a sub line internal conductor 22*a* above the main line internal conductor 21 and a sub line internal conductor 22*b* below the main line internal conductor 21 by via holes 34*a* and 34*b*.

With this directional coupler according to the second preferred embodiment, the partial regions 1*a* and 2*a* of the main line 1 and sub line 2 are arranged to face one another with insulating layers 33*a* and 33*b* disposed therebetween (i.e., superimposed), thereby effecting line coupling (distributed constant coupling) between the main line 1 and sub line 2.

Next, a method for manufacturing the directional coupler according to the second preferred embodiment will be described. As with the case of the first preferred embodiment, description will be made regarding a case of manufacturing one directional coupler, but generally, a method is used wherein a great number of main lines and sub lines are formed on a mother substrate, which is then cut at predetermined positions to divide the mother substrate into individual directional couplers, thereby simultaneously manufacturing a great number of directional couplers.

Also, the type of substrate, the type of material used for internal conductive patterns and insulating layers and so forth, and the methods for forming the internal conductive patterns by film formation or photolithography, or other suitable process, are the same as described above with the first preferred embodiment of the present invention.

Figure 11A:
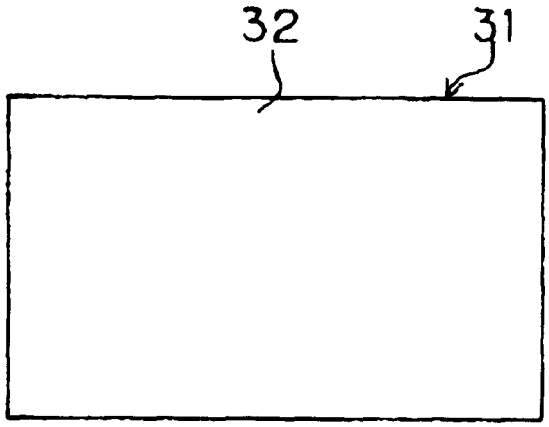
Figure 11B:
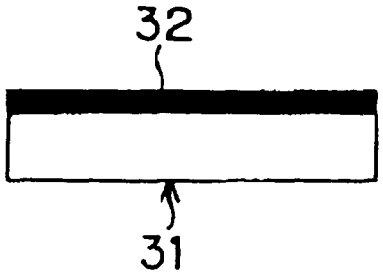

(1) First, as shown in FIGS. 11A and 11B, an internal conductor formation conductive film 32 for forming the lower sub line is formed on the substrate 31.

Figure 12A:
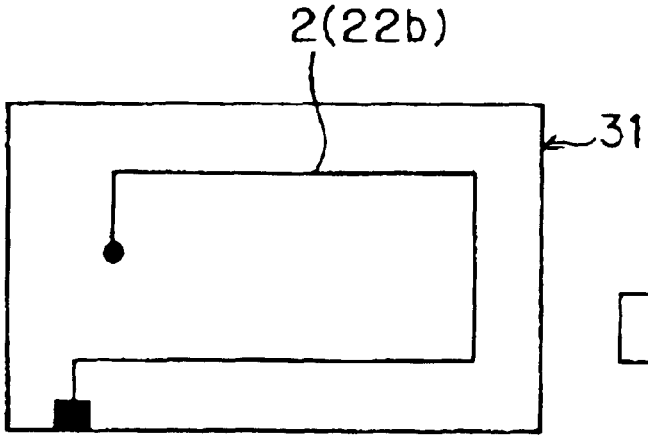
Figure 12B:
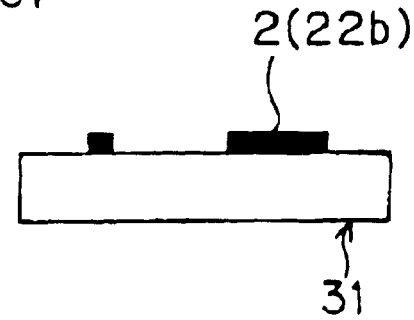

(2) Next, the conductive film 32 is patterned by photolithography, so as to form the internal conductive pattern 22*b* for the sub line on the lower side, as shown in FIGS. 12A and 12B.

Figure 13A:
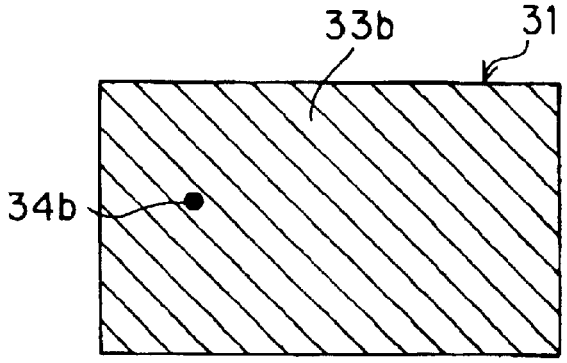
Figure 13B:
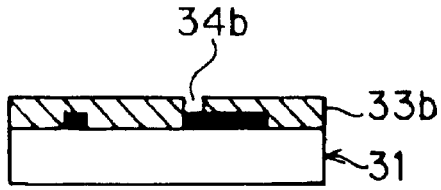

(3) Next, as shown in FIGS. 13A and 13B, an insulating layer 33*b* is arranged so as to cover the entire surface of the substrate 31 upon which is formed the internal conductive pattern 22*b* for the lower sub line, while also forming a via hole 34*b* (a via hole 34*b* for connecting the internal conductive pattern 22*b* for the lower sub line with an internal conductive pattern 22*a* for the upper sub line) in the insulating layer 33*b* by photolithography.

Figure 14A:
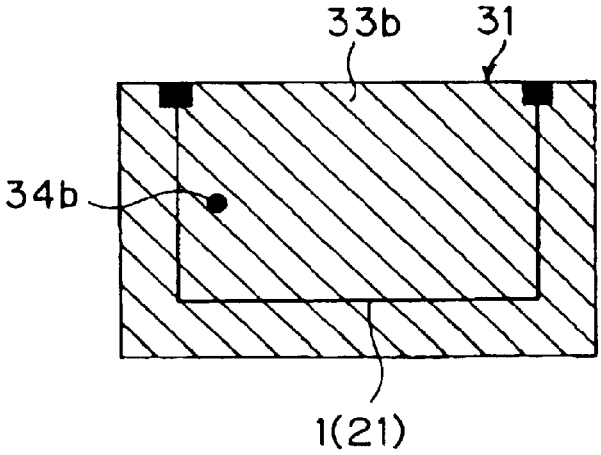
Figure 14B:
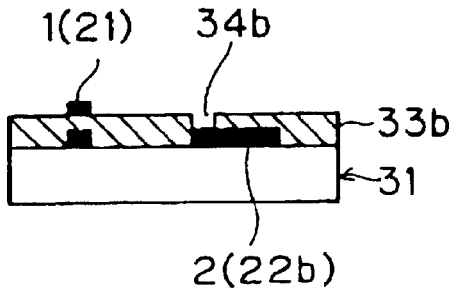

(4) Next, as shown in FIGS. 14A and 14B, the internal conductive pattern 21 for the main line is formed on the insulating layer 33*b*.

Figure 15A:
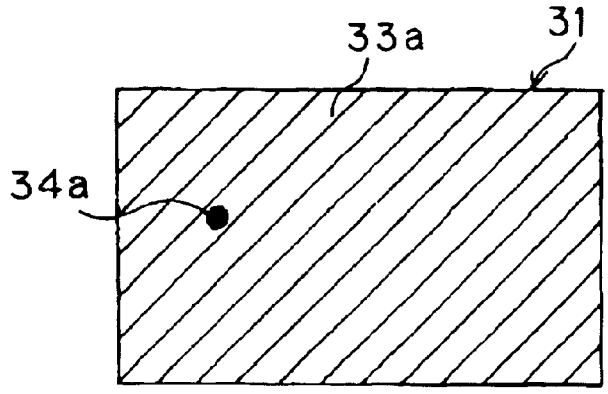
Figure 15B:
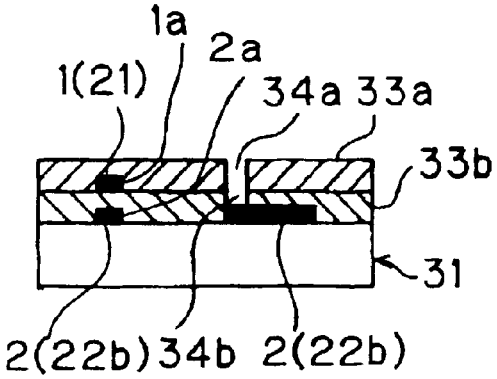

(5) Next, as shown in FIGS. 15A and 15B, an insulating layer 33*a* is formed so as to cover the entire surface of the substrate 31 upon which is formed the internal conductive pattern 21, while also forming a via hole 34*a* (a via hole 34*a* for connecting the internal conductive pattern 22*b* for the lower sub line with an internal conductive pattern 22*a* for the upper sub line) in the insulating layer 33*a* by photolithography.

Figure 16A:
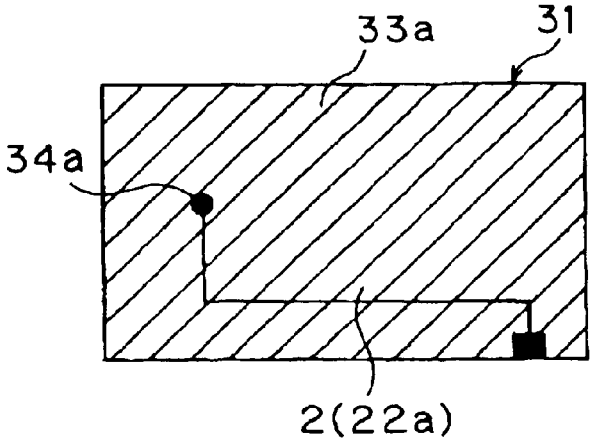
Figure 16B:
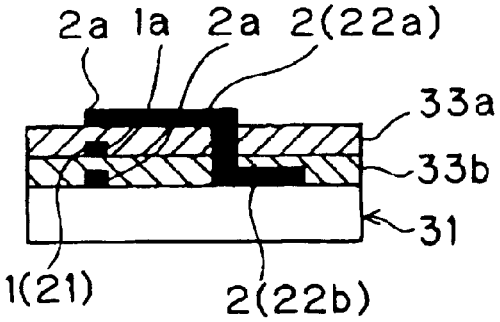

(6) Then, as shown in FIGS. 16A and 16B, the internal conductive pattern 22*a* for the sub line is formed on the insulating layer 33*a*, and also, the internal conductive patterns 22*a* and 22*b* for the upper layer and lower layer sub lines are conducted through the via hole 34*a* and the via hole 34*b*.

Figure 17A:
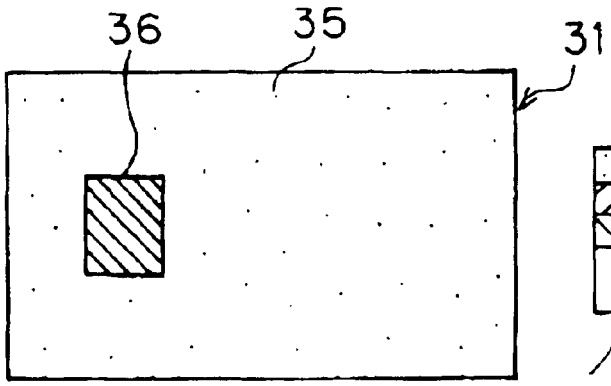
Figure 17B:
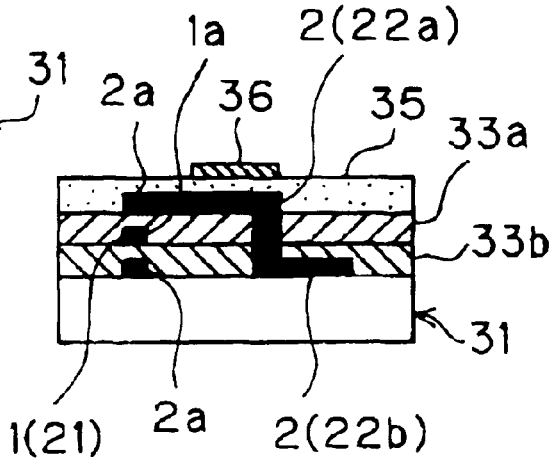

(7) Next, following the step of covering with an enveloping insulating material 35, a positioning mark 36 is formed on the enveloping insulating material 35 by printing a marking material at a predetermined position, as shown in FIGS. 17A and 17B. In the event of using a method wherein a great number of devices are manufactured simultaneously, the mother substrate is cut into the individual devices 10 following the formation of the positioning mark 36.

(8) Then, external electrodes 11*a* and 11*b*, and external electrodes 12*a* and 12*b*, are formed by coating and baking a conductive paste at predetermined positions on the device 10, or a similar method. Thus, a directional coupler such as shown in FIG. 9 can be obtained.

With the directional coupler according to the second preferred embodiment that is configured as described above, the line length of the sub line 2 is preferably longer than the line length of the main line 1, thereby enabling isolation properties to be improved, and the desired degree of coupling can be obtained while securing directivity, as with the above-described first preferred embodiment of the present invention.

Also, a portion of the main line 1 and sub line 2 are arranged to face one another with insulating layers 33*a* and 33*b* disposed therebetween (i.e., superimposed), thereby effecting line coupling (distributed constant coupling) between the main line 1 and sub line 2, so the degree of coupling can be adjusted by simply adjusting the thickness of the insulating layers 33*a* and 33*b*, without changing the line patterns, and directional couplers with various degrees of coupling can be readily obtained.

Note that while the main line in the second preferred embodiment has been described as a one-layer structure, the main line may be a multi-layer structure having two or more layers.

Figure 18:
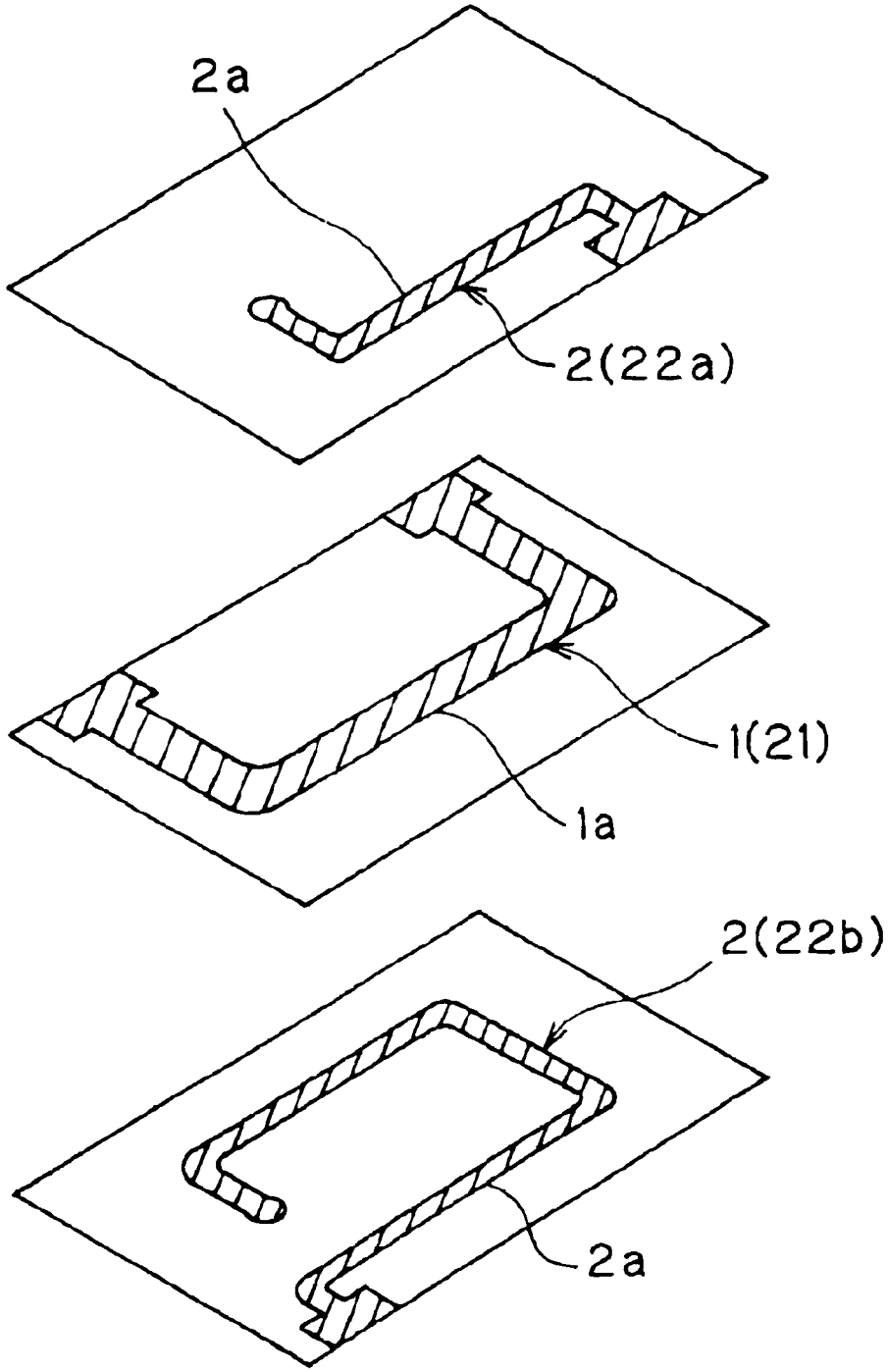
FIG. 18 is a disassembled perspective view illustrating internal conductor patterns configuring the main line and sub line of the directional coupler according to a modification of preferred embodiments of the present invention.

Also, with this directional coupler according to the second preferred embodiment, the partial regions 1*a* and 2*a* of the main line 1 and sub line 2 are arranged to face one another with insulating layers 33*a* and 33*b* disposed therebetween (i.e., superimposed), thereby effecting line coupling (distributed constant coupling) between the main line 1 and sub line 2, but an arrangement may be made as shown in FIGS. 18A and 18B, wherein the partial regions 1*a* and 2*a* of the main line 1 and sub line 2 are not arranged to face one another (superimposed) with insulating layers 33*a* and 33*b* disposed therebetween, but rather are arranged such that the partial regions 1*a* and 2*a* of the main line 1 and sub line 2 are substantially parallel which viewed in a planar manner, thereby effecting line coupling (distributed constant coupling) between the main line 1 and sub line 2.

Figure 19A:
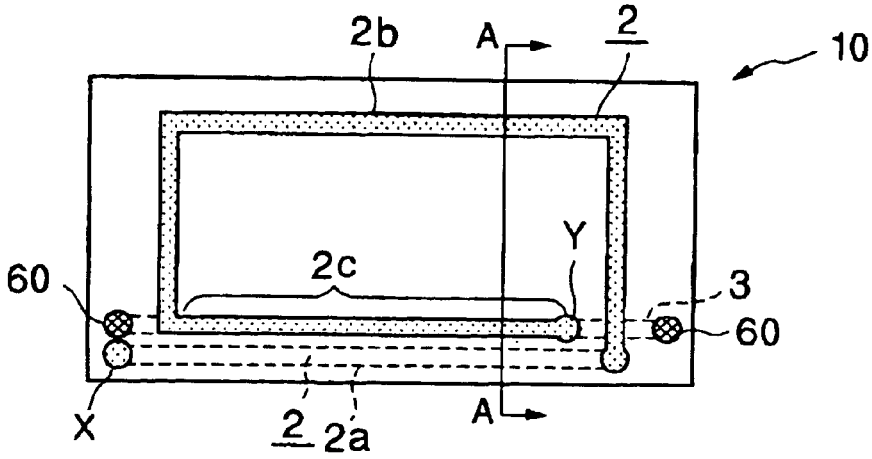
FIGS. 19A through 19C are diagrams describing the directional coupler according to a third preferred embodiment of the present invention.
Figure 19B:
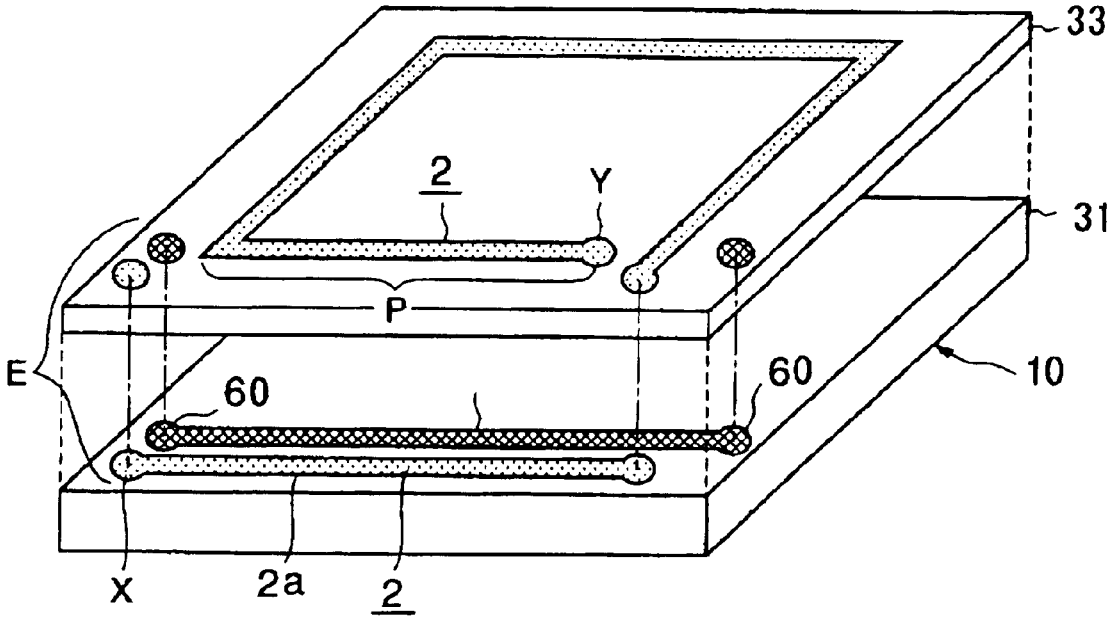
Figure 19C:
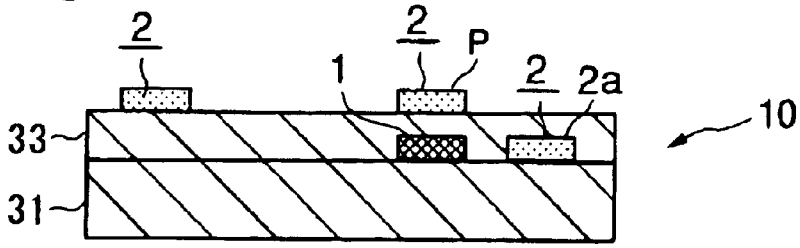

FIG. 19A is a model plan view of a directional coupler according to a third preferred embodiment, FIG. 19B is a disassembled view of the directional coupler according to the third preferred embodiment, and FIG. 19C is a cross-sectional view along line A—A in FIG. 19A.

With the third preferred embodiment, the device 10 is disposed in an insulating member, and has a multi-layer structure. A main line 1 is disposed on the substrate 31 of the device 10. This main line 1 is preferably formed as a straight line over the entire length thereof, from one end of the substrate 31 to the other end, and external connecting electrodes 60 are provided on both ends of the main line 1. The main line 1 is connected by conductivity to external components, such as an antenna or a circuit of a signal supplying source, for example, through the external connecting electrodes 60.

The sub line 2 is arranged to span the substrate 31 and insulating layer 33, with the portion 2*a* thereof disposed on the substrate 31 (i.e., the portion defining a first layer) and the portion 2*b* thereof disposed on the insulating layer 33 (i.e., the portion defining a second layer) connected by a via hole. This sub line 2 has a substantially spiral shape.

With the third preferred embodiment, the portion 2*a* of the sub line 2 disposed on the substrate 31 is a straight line portion, which is arranged substantially parallel with the main line 1 across a gap therewith over the entire length thereof. Also, the portion 2*b* disposed on the insulating layer 33 has a partial straight line portion P which is disposed above the main line 1 so as to run along the main line 1 in a substantially parallel manner. External connecting electrodes X and Y are provided at both ends of the sub line 2, as with the main line 1, and the sub line 2 can be connected by conductivity to external circuits by the external connecting electrodes X and Y. Incidentally, while only two layers are shown in FIGS. 19A through 19C, an enveloping insulating layer for protecting the sub line 2 may be disposed on the insulating layer 33 of the second layer, for example.

With the third preferred embodiment, as described above, the sub line 2 has a portion 2*a* which is substantially parallel alongside the main line 1 with a gap therebetween, and a portion P above the main line 1 with a gap therebetween. The portions 2*a* and P of the sub line 2 and almost the entire length of the main line 1 define a coupling portion E where line coupling mutually occurs. That is, the length where coupling occurs between the sub line and the main line is longer in comparison with a configuration wherein the sub line is parallel only beside one side of the main line, as with the directional coupler 100 shown in FIG. 27. Accordingly, the degree of coupling between the main line and sub line can be increased without increasing the size of the device.

This has been confirmed by experiments performed by the Inventor. In the experiments, the degree of coupling between the main line and sub line was examined for the directional coupler 1 according to the third preferred embodiment, the directional coupler shown in FIG. 27, and the directional coupler shown in FIG. 28.

Figure 20:
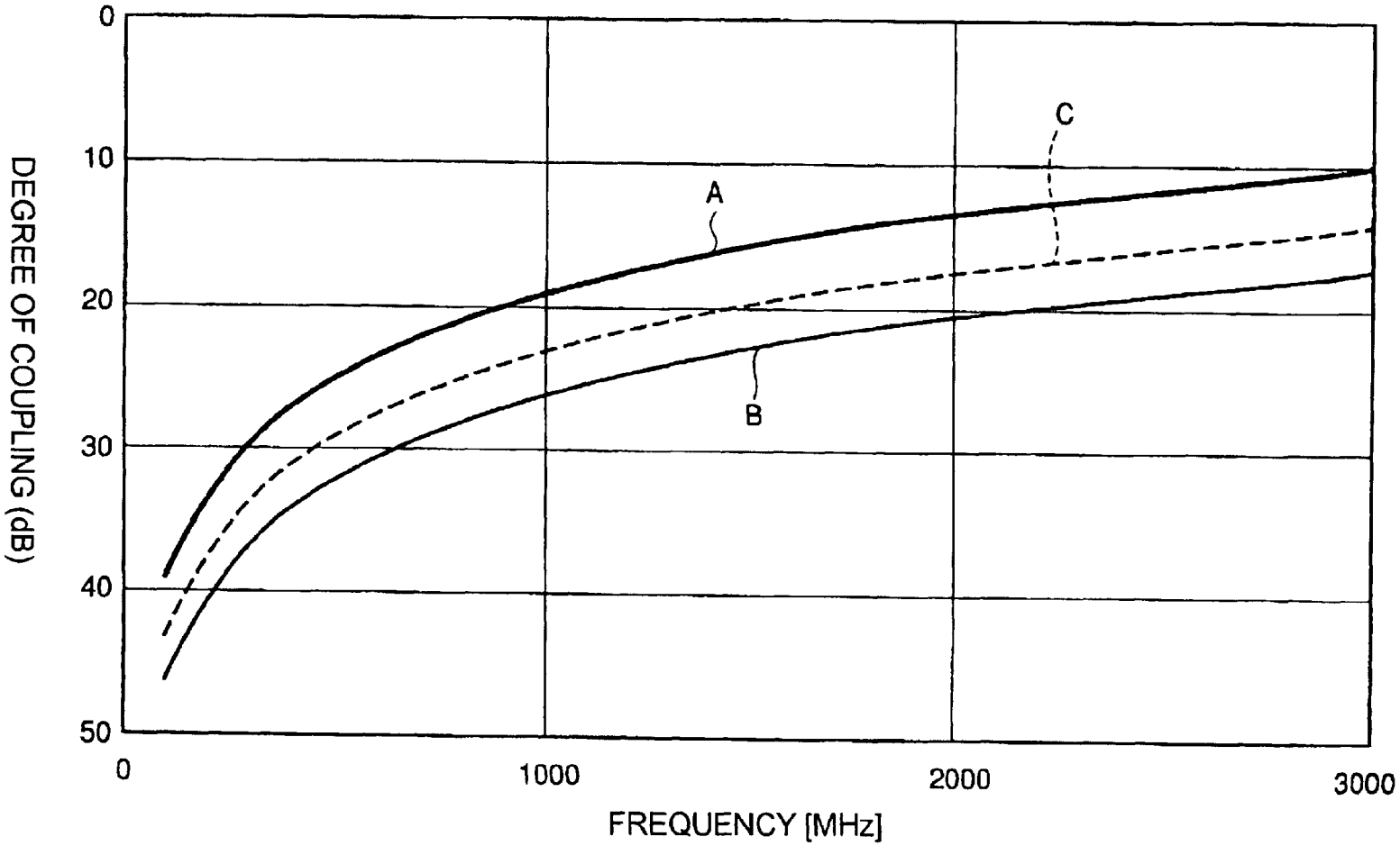
FIG. 20 is a graph describing the advantages of improved degree of coupling between the main line and sub line with the configuration shown in the third preferred embodiment of the present invention.

The results thereof are shown in FIG. 20. In FIG. 20, the solid line A indicates the results obtained from the directional coupler according to the third preferred embodiment, the solid line B indicates the results obtained from the directional coupler shown in FIG. 27, and the dotted line C indicates the results obtained from the directional coupler shown in FIG. 28. As can be understood from FIG. 20, the degree of coupling between the main line and sub line can be improved by the configuration of the third preferred embodiment in comparison with the configurations shown in FIG. 27 and FIG. 28.

Also, with the third preferred embodiment, the sub line 2 has a substantially spiral shape, which is a configuration that allows the inductance value of the sub line 2 to be increased. Accordingly, isolation properties can be improved.

Figure 21:
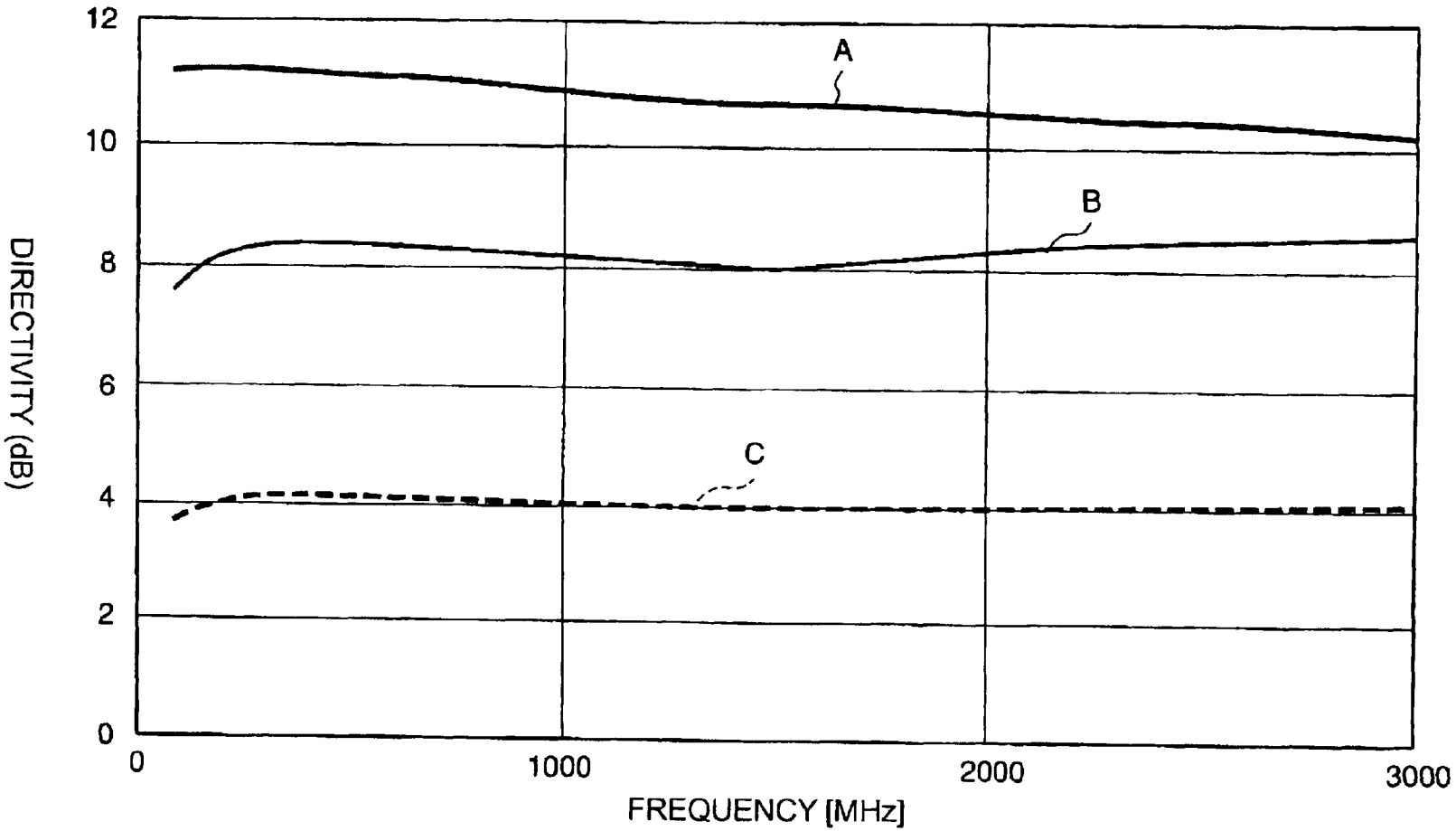
FIG. 21 is a graph describing the advantages of improved directivity with the configuration shown in the third preferred embodiment of the present invention.
Figure 27:
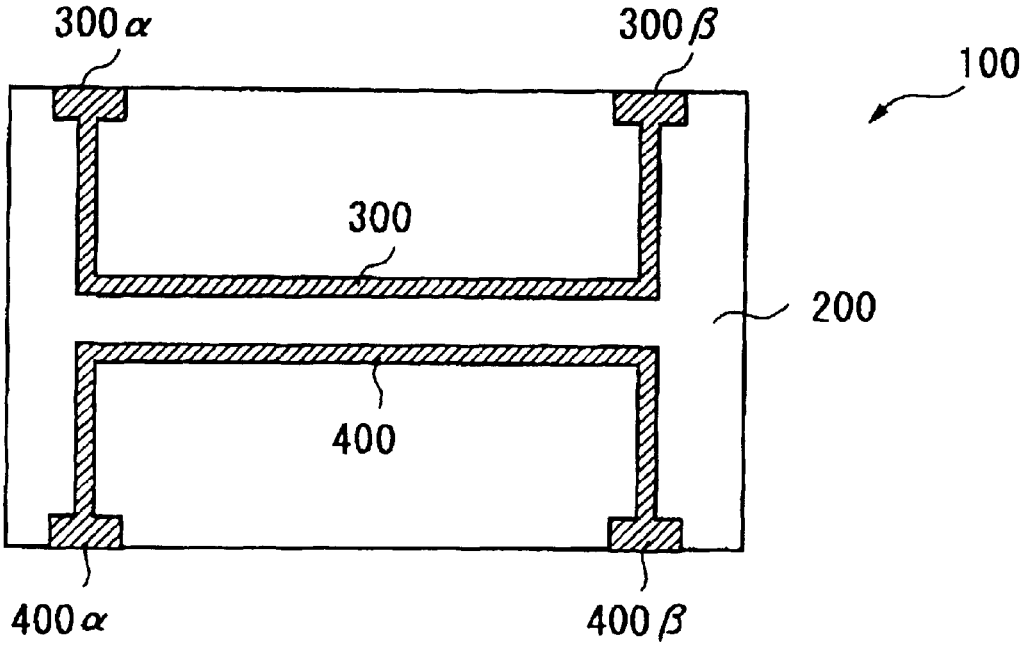
Fig.27 PRIOR ART
FIG. 27 is a plan view illustrating a conventional example of a directional coupler.
Figure 28:
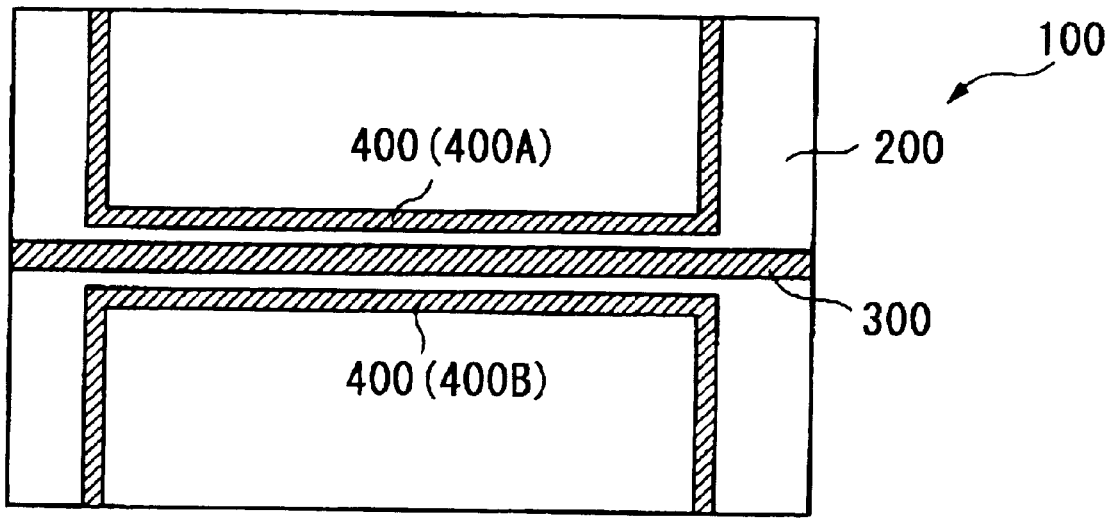
Fig.28 PRIOR ART
FIG. 28 is a plan view illustrating another conventional example of a directional coupler.

Thus, as can be understood from the experimentation results shown in FIG. 21 for examining directivity, the directional coupler having the configuration of the third preferred embodiment (see the solid line A) enables directivity to be markedly improved over that shown in FIG. 27 (solid line B) or that shown in FIG. 28 (dotted line C). Note that with the third preferred embodiment, the sub line is preferably disposed near and along the edge of the substrate in order to raise the inductance value of the sub line as much as possible and improve directivity, and the length thereof is long.

As described above, due to the configuration of the third preferred embodiment, a directional coupler can be readily provided which has been reduced in size while raising directivity and improving the detection accuracy of signals which the sub line 2 detects from the main line 1.

Also, with the third preferred embodiment, the main line preferably has a straight line configuration over the entire length thereof, thus suppressing the length of the line. This yields the following advantages. For example, in the event that the main line 1 is long, insertion loss increases, which leads to the problem in that the electric power consumption of the equipment to which the directional coupler is assembled increases. For example, in the event that the directional coupler is mounted to a battery-driven device such as a cellular telephone or other suitable device, increased insertion loss of the main line causes the problem of accelerated use of the battery of the device. Conversely, with the third preferred embodiment, the main line 1 has a straight line configuration with a short length, so insertion loss can be minimized, and accordingly, the electric power consumption of the device to which the directional coupler is assembled can be minimized.

Figure 22A:
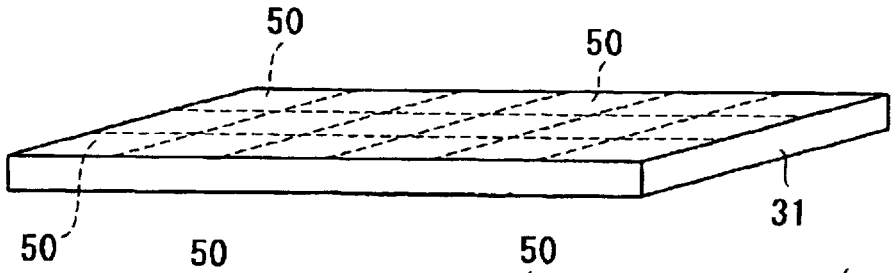
FIGS. 22A through 22F are diagrams describing an example of a manufacturing procedures of the directional coupler according to the third preferred embodiment of the present invention.

Now, a method for manufacturing the directional coupler according to the third preferred embodiment will be described with reference to FIGS. 22A through 22F. First, as shown in FIG. 22A, a mother substrate 31 for forming multiple directional couplers 1 is prepared. The material forming the mother substrate 31 is, for example, ceramic such as alumina or glass ceramics, ferrite, or other dielectric substances.

Figure 22B:
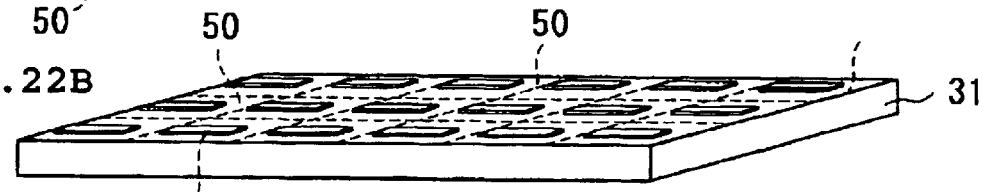

As shown in FIG. 22B in model fashion, the lines to be formed on the first layer, i.e., the main line 1 and the portion 2*a* of the sub line 2, are formed on each directional coupler formation region 50 of the mother substrate 31.

One technique which can be used for forming the lines is photolithography. In the event of using photolithography, first, a conductive film is formed on the entire upper surface of the mother substrate 31 by printing or film formation (e.g., sputtering, vapor deposition, or other suitable process). Next, the conductive film is coated with a photo resist, which is exposed through a photo mask in the pattern of the main line 1 and the portion 2*a* of the sub line 2 on the first layer. The unnecessary photo-resist is removed with a solvent or other suitable material. Subsequently, the main line 1 and the portion 2*a* of the sub line 2 on the first layer are formed by applying wet etching, dry etching, lift-off, additive, semi-additive, or a similar technique, to the conductive layer.

Also, the main line 1 and the portion 2*a* of the sub line 2 on the first layer may be formed by a printing technique for example, instead of forming the main line 1 and the portion 2*a* of the sub line 2 on the first layer by photolithography. In this case, the main line 1 and the portion 2*a* of the sub line 2 on the first layer can be formed on each directional coupler formation region 50 of the mother substrate 31 by printing a conductive paste on the surface of the mother substrate 31 using a mask pattern.

Figure 22C:
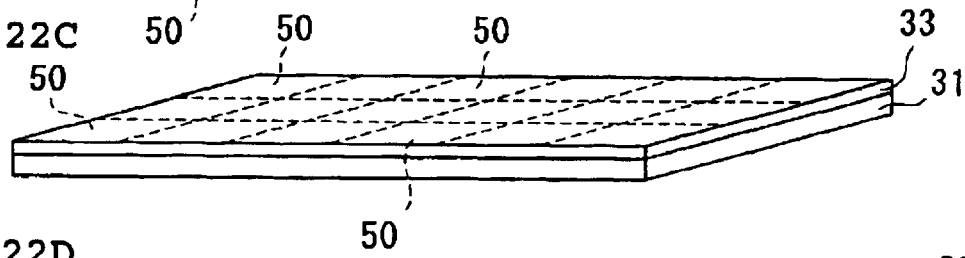

Following the step of forming the main line 1 and the portion 2*a* of the sub line 2 of the first layer as described above, an insulating layer 33 having a thickness that is greater than that of the lines is formed so as to cover the entire surface of the substrate 31 by printing or spin coating for example, as shown in FIG. 22C. Examples of the material for the insulating layer 33 include glass, polyimide, or photosensitive glass or photosensitive polyimide wherein a photosensitive material has been blended therein, and so forth.

Then, via holes are formed in the insulating layer 33, at each of the directional coupler formation regions 50.

Figure 22D:
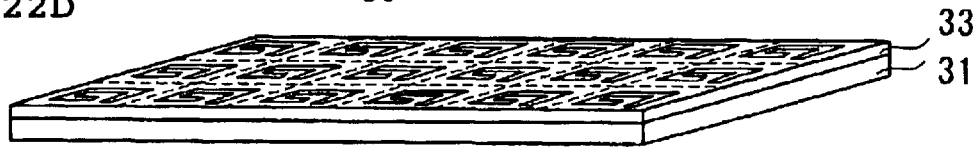

Later, the line to be formed on the second layer of the substrate 31, i.e., the second layer formation portion 2*b* of the sub line 2 in the case of the third preferred embodiment, is formed on the insulating layer 33 for each of the coupler formation regions 50, as shown in FIG. 22D, in the same manner as described above.

Figure 22E:
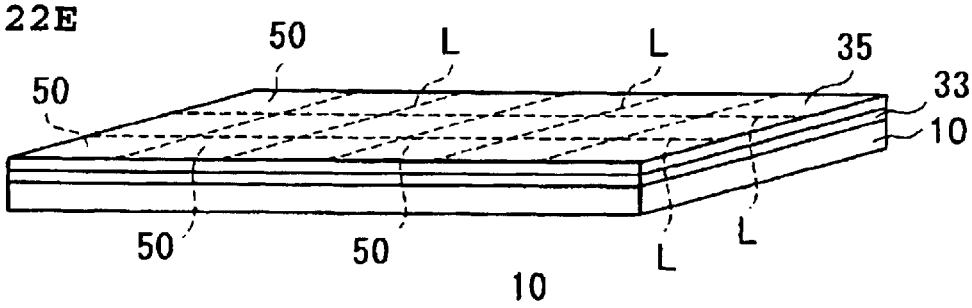

Subsequently, as shown in FIG. 22E, the entire upper surface of the insulating layer 33 is covered with an insulating layer 35 to a thickness that is greater than that of the line so as to form an enveloping insulating layer, with the same technique as the insulating layer 33.

Figure 22F:
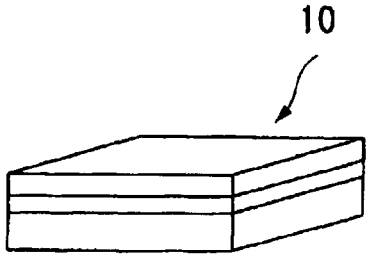

The mother substrate 31 is then divided along boundary lines L between the directional coupler formation regions 50, so that a great number of directional couplers 1 such as shown in FIG. 22F are obtained. Examples of techniques for dividing the mother substrate 31 include dicing, scribe breaking, and other suitable processes. Also, in the procedure for dividing mother substrate 31, positioning marks or other such indicia may be formed on the insulating layer 35 of the mother substrate 31 before dividing the mother substrate 31, in order to precisely position the mother substrate 31 at the mounting position thereof.

Thus, directional couplers 1 can be provided.

Figure 23A:
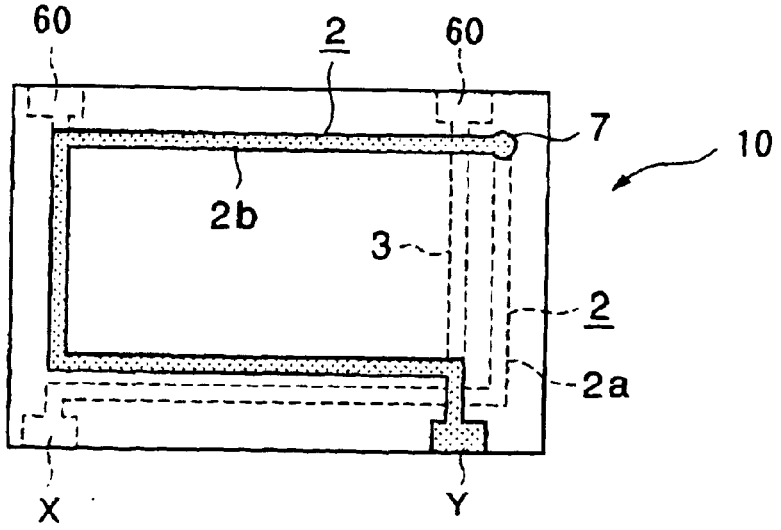
FIGS. 23A and 23B are diagrams describing the directional coupler according to a fourth preferred embodiment of the present invention.
Figure 23B:
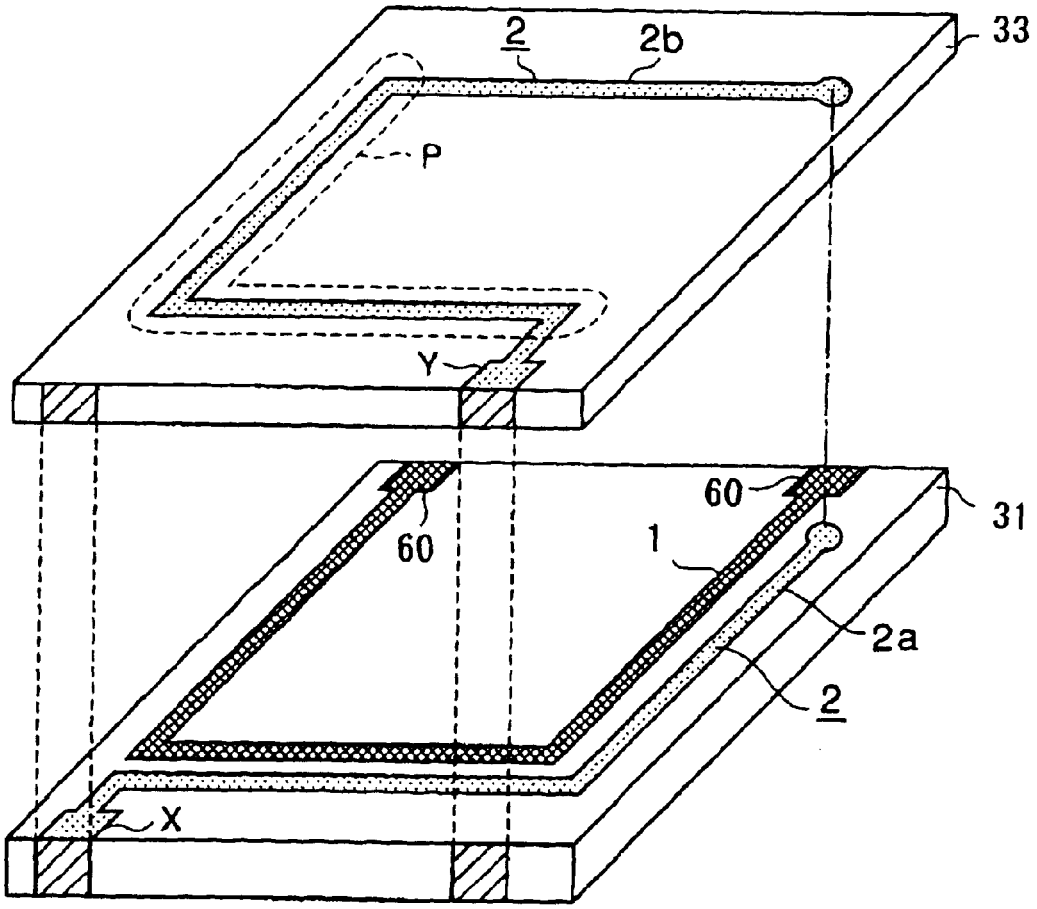

FIG. 23A is a model plan view of a directional coupler according to a fourth preferred embodiment of the present invention, and FIG. 23B is a model disassembled view of the directional coupler according to the fourth preferred embodiment of the present invention.

In this fourth preferred embodiment, the main line 1 disposed on the substrate 31 preferably has a substantially U-shaped configuration. External connecting electrodes 60 are provided on both ends of the main line 1 in the same way as with the third preferred embodiment, for connection to circuits through terminals provided on the side of the substrate.

As with the third preferred embodiment, the sub line 2 preferably has a substantially spiral shape spanning the substrate 31 which is the first layer and insulating layer 33 which is the second layer, with the first layer formation portion 2*a* and the second layer formation portion 2*b* connected by a via hole. The first layer formation portion 2*a* of the sub line 2 is arranged in parallel with the main line 1 at the side thereof across a gap therewith over most of the length thereof. The second layer formation portion 2*b* of the sub line 2 has a portion P which is disposed above the main line 1 across a gap so as to extend along the main line 1 substantially parallel as a straight line. External connecting electrodes X and Y are disposed on both ends of the sub line 2, as with the main line 1, and the sub line 2 is connected to circuits through terminals provided on the side of the substrate.

With the fourth preferred embodiment, as with the third preferred embodiment, the sub line 2 has a portion P above the main line 1 with a gap therebetween, and a portion 2*a* which is substantially parallel alongside the main line 1, and the coupling portion E where line coupling occurs between the main line 1 and the sub line 2 can be made to be long, so the degree of coupling between the main line 1 and sub line 2 can be increased without increasing the size of the substrate 31.

Moreover, the sub line 2 has a substantially spiral shape, so the inductance value of the sub line 2 can be increased, thereby improving isolation properties. The improvement in isolation properties and the effects of improved degree of coupling work together to markedly improve directivity, while reducing the size of the directional coupler 1. Thus, the detection accuracy of signals of the main line 1 by the sub line 2 is greatly improved.

Figure 24A:
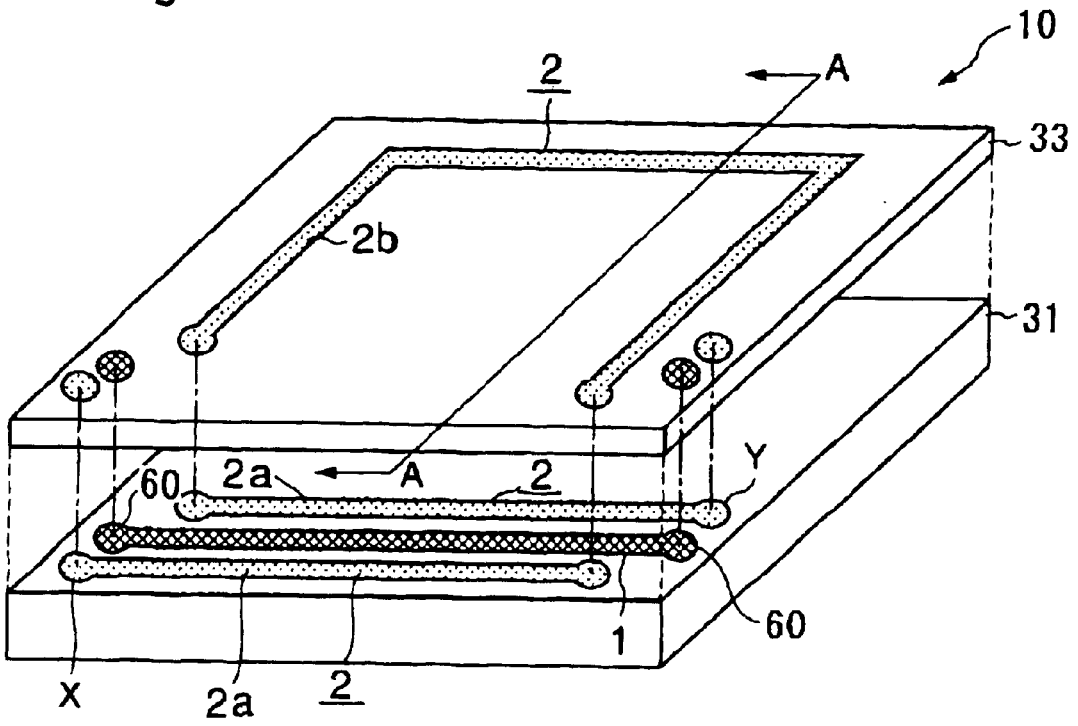
FIGS. 24A and 24B are diagrams illustrating another arrangement for carrying out the fourth preferred embodiment of the present invention.
Figure 24B:
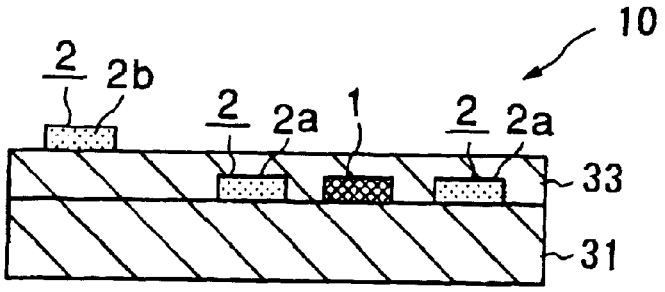
Figure 25A:
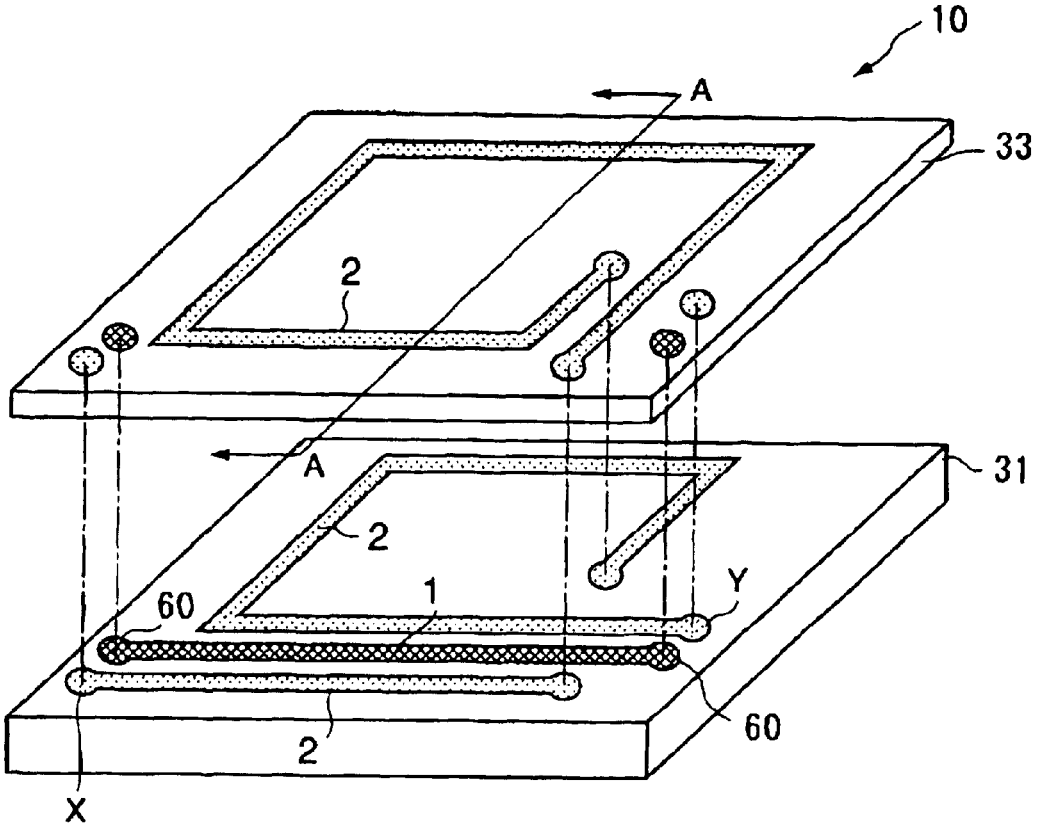
FIGS. 25A and 25B are diagrams illustrating yet another arrangement for carrying out the fourth preferred embodiment of the present invention.
Figure 25B:
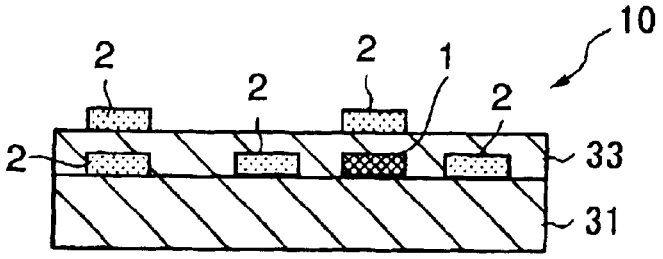

It should be noted that the present invention is by no means restricted to the above-described preferred embodiments. Instead, the present invention may take many forms. For example, while the third and fourth preferred embodiments describe the sub line 2 as having a portion P which is laid above the main line 1 across a gap so as to extend along the main line 1 in a substantially parallel manner, and a portion 2*a* arranged substantially parallel with the main line 1 at the side thereof across a gap therewith, but as shown in the cross-sectional view in FIG. 24B, for example, the substantially spiral-shaped sub line 2 may have a configuration of a portion which extends in a straight line alongside the main line 1 substantially parallel with a gap therebetween on the same surface, and a portion which extends substantially parallel on the other side in a straight line with a gap therebetween. In this case, for example, the main line 1 and sub line 2 having a positional relationship such as shown in the cross-sectional view in FIG. 24B may be formed by forming the main line 1 and sub line 2 as shown in the disassembled view in FIG. 24A. Note that 24B is a cross-sectional view corresponding to line A—A in FIG. 24A Also, for example, the substantially spiral-shaped sub line 2 may have a configuration of a portion which extends in a straight line above the main line 1 with a gap therebetween, a portion which extends substantially parallel in a straight line on one side of the main line 1 on the same surface therewith with a gap therebetween, and a portion which extends substantially parallel in a straight line on the other side thereof with a gap therebetween. In this case, the main line 1 and substantially spiral-shaped sub line 2 having a positional relationship such as shown in the cross-sectional view in FIG. 25B may be formed by forming the main line 1 and sub line 2 as shown in the disassembled view in FIG. 25A. Note that 25B is a cross-sectional view corresponding to line A—A in FIG. 25A.

Further, for example, the substantially spiral-shaped sub line 2 may have a configuration of a portion which extends in a straight line above the main line 1 with a gap therebetween, and a portion which extends in a straight line below the main line 1 with a gap therebetween. In this case, the main line 1 and substantially spiral-shaped sub line 2 having a positional relationship such as shown in the cross-sectional view in FIG. 26B may be formed by forming the main line 1 and sub line 2 as shown in the disassembled view in FIG. 26A. Note that 26B is a cross-sectional view corresponding to line A—A in FIG. 26A.

Figure 26A:
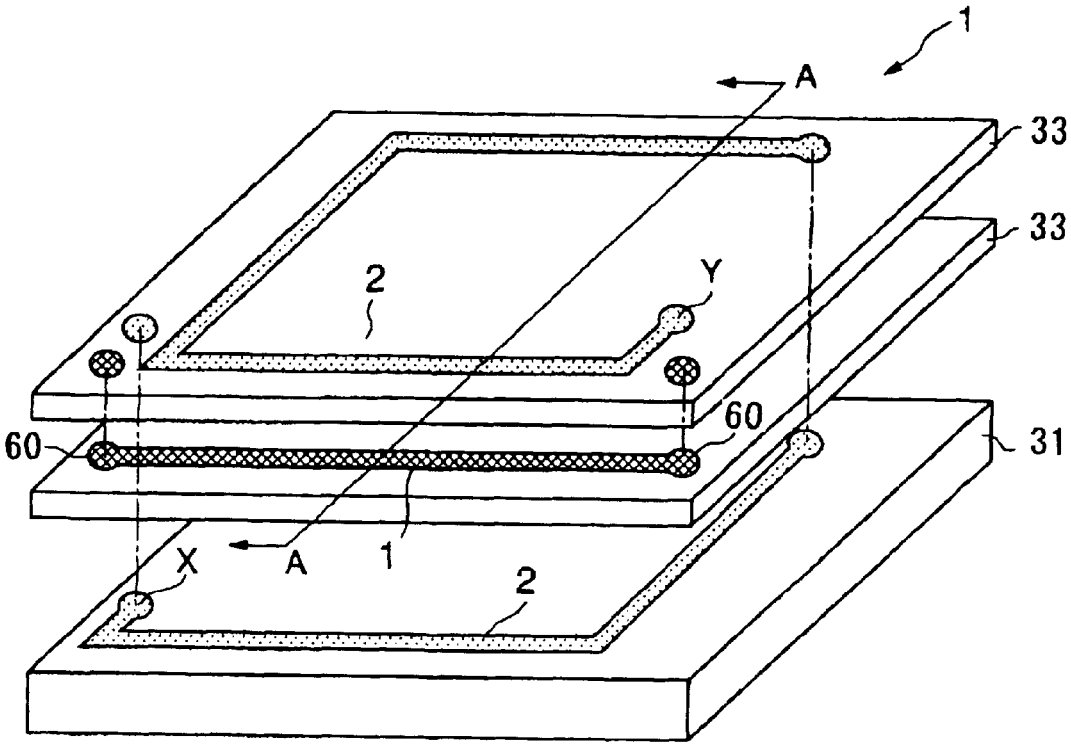
FIGS. 26A and 26B are diagrams illustrating still another arrangement for carrying out the fourth preferred embodiment of the present invention.
Figure 26B:
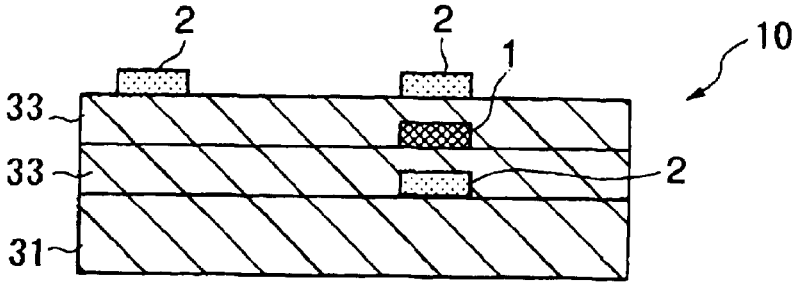

As illustrated in FIGS. 26A and 26B, the number of layers on which the lines 1 and 2 are formed may be one, two or more, that is to say, there is no restriction on the number thereof.

Further, the sub line 2 may have a configuration including all of a portion which extends above the main line 1 with a gap therebetween, and a portion which extends below the main line 1 with a gap therebetween, a portion which extends substantially parallel along the main line 1 on the same surface therewith with a gap therebetween, and a portion which extends substantially parallel on the other side thereof with a gap therebetween.

The present invention is in no way restricted to the preferred embodiments described above. Instead, various adaptations and modifications may be made with regard to specific patterns of the main line and sub line, the number of layers for layered structures, and other characteristics and features, without departing from the spirit or scope of the invention.

What is claimed is:

1. A directional coupling device comprising:

a main line; and a sub line; wherein at least a portion of the main line and the sub line are substantially parallel with each other such that line coupling is effected between the main line and sub line;

the main line includes a first electrode disposed on a first plane and a second electrode disposed on a second plane;

the sub line includes a third electrode disposed on a third lane and a fourth electrode disposed on a fourth plane;

the sub line has a spiral configuration; and the line length of said sub line is longer than the line length of said main line.

2. A directional coupling device according to claim 1, wherein said main line is one of a substantially straight line and a substantially straight line bending at a predetermined position.

3. A directional coupling device according to claim 2, wherein said sub line is a line which is substantially circular.

4. A directional coupling device according to claim 3, further comprising an insulating member, wherein said main line and sub line are embedded in the insulating member.

5. A directional coupling device according to claim 4, wherein said insulating member comprises a layered structure including a plurality of insulating layers that have been stacked on each other.

6. A directional coupling device according to claim 1, wherein line coupling of said sub line to said main line is achieved by a portion of said sub line being disposed on both sides of said main line.

7. A directional coupling device according to claim 5, wherein line coupling of said sub line to said main line is achieved by a portion of said sub line being disposed above and below said main line.

8. A directional coupling device according to claim 7, wherein at least one of said insulating layers is disposed between said portion of said sub line disposed above and below said main line.

9. A directional coupling device according to claim 1, wherein line coupling of said sub line to said main line is achieved by a portion of said sub line being disposed at two of at least one side of both sides of said main line, above said main line, and below said main line.

10. A directional coupling device according to claim 1, wherein said mainline and said sub line are made of at least one of photosensitive electroconductive material and photosensitive resist.

11. A directional coupling device according to claim 1, wherein the line width of said main line is greater than the line width of said sub line.

12. A directional coupling device according to claim 1, wherein the first plane is the third plane.

13. A directional coupling device according to claim 1, wherein the second plane is the fourth plane.

14. A directional coupling device according to claim 1, wherein the first electrode is connected to the second electrode.

15. A directional coupling device according to claim 1, wherein the third electrode is connected to the fourth electrode.

* * * * *